US005970676A

United States Patent [19]

Lindsay

[11] Patent Number: 5,970,676

[45] Date of Patent: Oct. 26, 1999

[54] OUTRIGGER SUPPORT FOR BUILDING STRUCTURE

[76] Inventor: Fredrick H. Lindsay, 9393—120th La. North, Seminole, Fla. 34642

[21] Appl. No.: 09/082,941

[22] Filed: May 21, 1998

Related U.S. Application Data

[60] Provisional application No. 60/050,203, Jun. 19, 1997, and provisional application No. 60/058,050, Sep. 6, 1997.

[51] Int. Cl.[6] ..... E04B 1/343

[52] U.S. Cl. ..... 52/634; 52/696; 52/143; 52/691; 52/690

[58] Field of Search ..... 52/634, 676, 143, 52/691, 690

[56] References Cited

U.S. PATENT DOCUMENTS

| | | | |
|---|---|---|---|
| 1,677,577 | 7/1928 | Amiot | 52/634 |
| 1,837,374 | 12/1931 | Samuel | 52/696 |
| 2,123,931 | 7/1938 | Bunker | 52/650.3 X |
| 2,284,898 | 6/1942 | Hartman | 189/34 |
| 2,743,940 | 5/1956 | Bohlen | 52/483.1 X |
| 2,925,727 | 2/1960 | Harris et al. | 52/650.3 X |
| 3,716,267 | 2/1973 | Lindsay . | |
| 3,751,870 | 8/1973 | Vesel . | |
| 4,015,375 | 4/1977 | Lindsay | 52/693 |
| 4,019,299 | 4/1977 | Lindsay . | |
| 4,106,258 | 8/1978 | Lindsay | 52/693 |
| 4,441,289 | 4/1984 | Ikuo et al. | 52/167 |
| 4,669,243 | 6/1987 | Gore et al. | 52/696 |
| 4,863,189 | 9/1989 | Lindsay | 52/650.3 X |
| 4,930,809 | 6/1990 | Lindsay . | |
| 5,028,072 | 7/1991 | Lindsay . | |
| 5,201,546 | 4/1993 | Lindsay . | |
| 5,226,583 | 7/1993 | Imashimizo et al. . | |
| 5,359,821 | 11/1994 | Merriman | 52/169.9 |
| 5,488,809 | 2/1996 | Lindsay . | |
| 5,579,622 | 12/1996 | De Von et al. . | |
| 5,640,814 | 6/1997 | Godfrey | 52/143 |
| 5,671,573 | 9/1997 | Tadros et al. | 52/223.8 |

*Primary Examiner*—Carl D. Friedman
*Assistant Examiner*—Phi Dieu Tran A
*Attorney, Agent, or Firm*—Frijouf, Rust & Pyle, P.A.

[57] ABSTRACT

An improved outrigger is disclosed for a building structure having a longitudinally extending I-beam. The outrigger comprises an inner member having an upper end and a lower end and an outer member having an upper end and a lower end. A brace coacts between the lower end of the inner member and the upper end of the outer member and coacts between the upper end of the inner member and the lower end of the outer member. The inner member is connected to the I-beam.

14 Claims, 26 Drawing Sheets

71
100
120
140
110
150
130
61
60
21
24
22
230
250
210
240
220
200
62
72

OUTRIGGER SUPPORT FOR BUILDING STRUCTURE

CROSS-REFERENCE TO RELATED APPLICATIONS

This application claims benefit of United States Patent Provisional application Ser.No. 60/050,203 filed Jun. 19, 1997 and United States application Ser. No. 60/058,050 filed Sept. 6, 1997. All subject matter set forth in provisional application Ser. No. 60/050,203 and set forth in provisional application Ser. No. 60/058,050 are hereby incorporated by reference into the present application as fully set forth herein.

BACKGROUND OF THE INVENTION

1. Field Of The Invention

This invention relates to building structures and more particularly to an improved outrigger for a frame of a building structure such as a manufactured home or the like.

2. Background Of The Invention

Various systems have been devised in the prior art for use in providing a floor to a building structure such as a manufactured home of the like. Many building structures incorporate a first and a second longitudinally extending I-beam for supporting a plurality of transverse beams. The transverse beams provide a support for the floor system of the building structure. In many cases, it is desirable to extend the transverse beams outwardly of the first and second longitudinally extending I-beams. In such cases, it is sometimes desirable to provide additional support to these transverse beams extending outwardly of the first and second I-beams.

Some in the prior art have proposed the use of outriggers fastened to the first and second I-beams to extend substantially perpendicularly to the I-beams. The outriggers receive an outer beam for supporting the terminal ends of the transverse beams. Some in the prior art have made these outriggers of wood that incorporate various bracing devices. Others in the prior art have attempted to use steel Z shape portions in an effort to provide outriggers for manufactured homes.

It is an object of this invention to provide an improved outrigger for a building structure which is capable of being secured to an I-beam of a building structure home for supporting the terminal ends of the transverse beams.

Another object of this invention is to provide an improved outrigger for a building structure which is fashioned from light-weight steel angle iron material to provide a light-weight outrigger for the building structure industry.

Another object of this invention is to provide an improved outrigger for a building structure which is designed to be structurally strong and efficient for being supported either from the underside of the l-beams or for being supported from the underside of the terminal ends of the outriggers.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention and the detailed description describing the preferred embodiment of the invention.

SUMMARY OF THE INVENTION

A specific embodiment of the present invention is shown in the attached drawings. For the purpose of summarizing the invention, the invention relates to an improved outrigger for a building structure, the building structure having a longitudinally extending I-beam. The improved outrigger comprises an inner member having an upper end and a lower end and an outer member having an upper end and a lower end. A brace coacts between the lower end of the inner member and the upper end of the outer member and coacts between the upper end of the inner member and the lower end of the outer member. The inner member is connected to the I-beam.

In one embodiment of the invention, the inner and the outer members are metallic angles. In this example, the first and second braces are metallic angles.

In another example of the invention, the inner member, the outer member and the brace are unitary and formed from a sheet of metallic material. In this example, the brace is formed by bending a portion of the sheet of metallic material. The improved outrigger may include a strengthening member for reinforcing the brace.

In a more specific embodiment of the invention, the outrigger comprises an inner member having an upper end and a lower end and an outer member having an upper end and a lower end. A first brace coacts between the lower end of the inner member to the upper end of the outer member. A second brace coacts between the upper end of the inner member to the lower end of the outer member. The first brace is connected to the second brace. The inner member is connected to the I-beam.

In a more specific embodiment of the invention, the top and bottom portions of the I-beam are substantially horizontal and the interconnecting portion of the I-beam is substantially vertical. Preferably, the inner and outer members are fabricated from steel angle iron. In a similar fashion, the first and second braces are steel angle irons.

In one embodiment of the invention, the first and second braces are connected to the inner and outer members by welding. Preferably the first and second braces are interconnected by welding.

In another embodiment of the invention, the inner member, the outer member and the first and second braces are unitary. A strengthening member is secured to the unitary member for connecting the first brace to the second brace.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several FIGS. of the drawings.

DETAILED DISCUSSION

Figure 1:
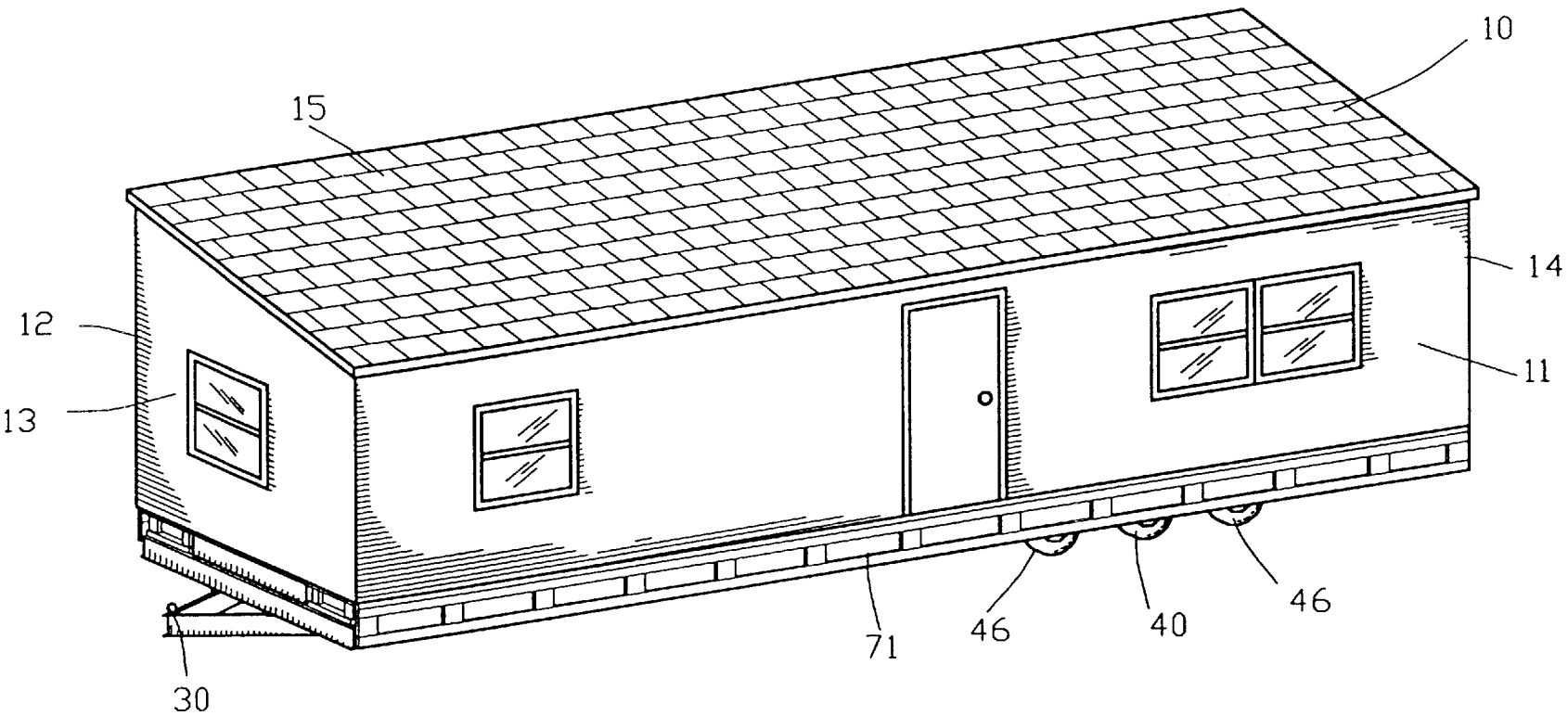
FIG. 1 is an isometric view of a first embodiment of a building structure shown as a manufactured home incorporating the present invention.
Figure 2:
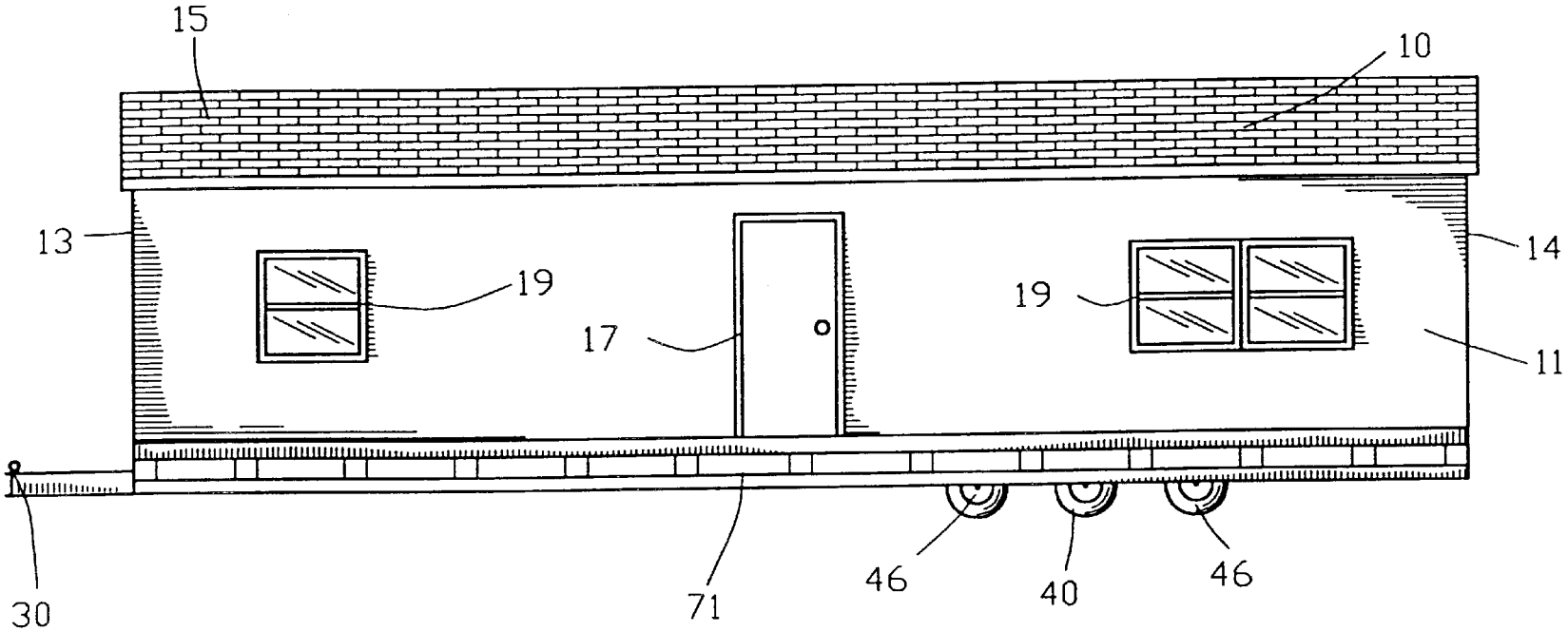
FIG. 2 is a side elevational view of FIG. 1.
Figure 3:
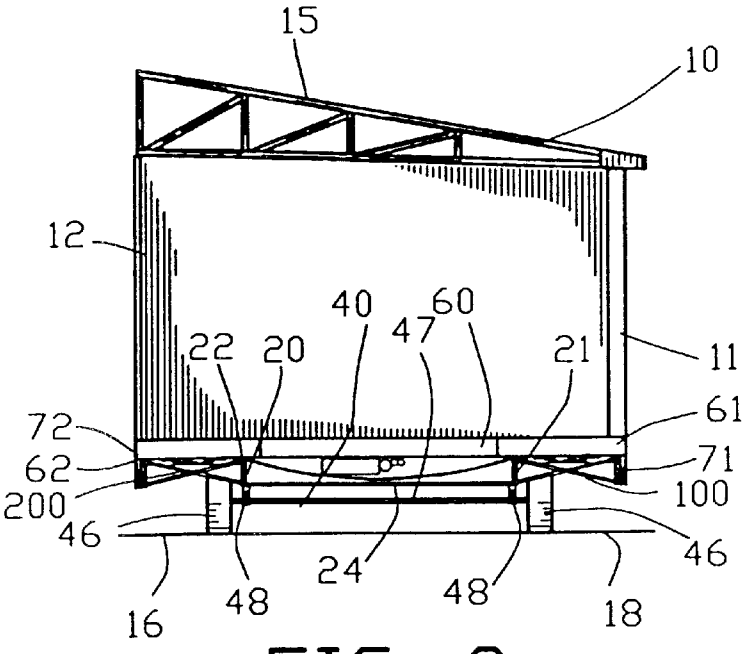
FIG. 3 is an end view of FIG. 2 illustrating the building structure disposed on the carrier transport.

FIGS. 1–3 are isometric, side and end views of a first embodiment of a building structure 10. Although the building structure 10 is shown as a manufactured home in FIG. 1–3, it should be understood that the present invention may be incorporated into a wide variety of building structures. The building structure 10 comprises peripheral walls 11 and 12, end walls 13 and 14 and a roof 15. The building structure 10 is designed to be transported to a remote location and to be erected on a ground surface 16 at a building site 18.

After the building structure 10 is completed at a manufacturing facility, the building structure 10 is towed by a towing vehicle such as a truck (not shown) to the building site 18. The building structure 10 is shown as one-half of a two-part unit commonly referred to as a double wide building structure 10. In the case of a double wide building structure 10, the peripheral wall 12 is only a partial wall enabling the building structure 10 to be joined with a mirror image of FIG. 3 at the peripheral wall 12 for creating the double wide building structure 10. The structure and erection of the double wide building structure 10 should be well known to those skilled in the art.

As best shown in FIG. 3, the building structure 10 is shown disposed on a longitudinally extending beam 20 shown as frame elements 21 and 22. Preferably, the frame elements 21 and 22 are steel I-beams separated by a plurality of struts 24. A removable hitch 30 and a plurality of removable wheel assemblies 40 enable the building structure 10 to be towed to the building site 18. Each of the plurality of wheel assemblies 40 has plural wheels 46 journaled on an axle 47. The plurality of wheel assemblies 40 are secured to the frame elements 21 and 22 by springs 48. Upon reaching the building site 18, the removable hitch 30 and the plurality of removable wheel assemblies 40 are removed and the building structure 10 is permanently mounted at the building site 18.

Figure 4:
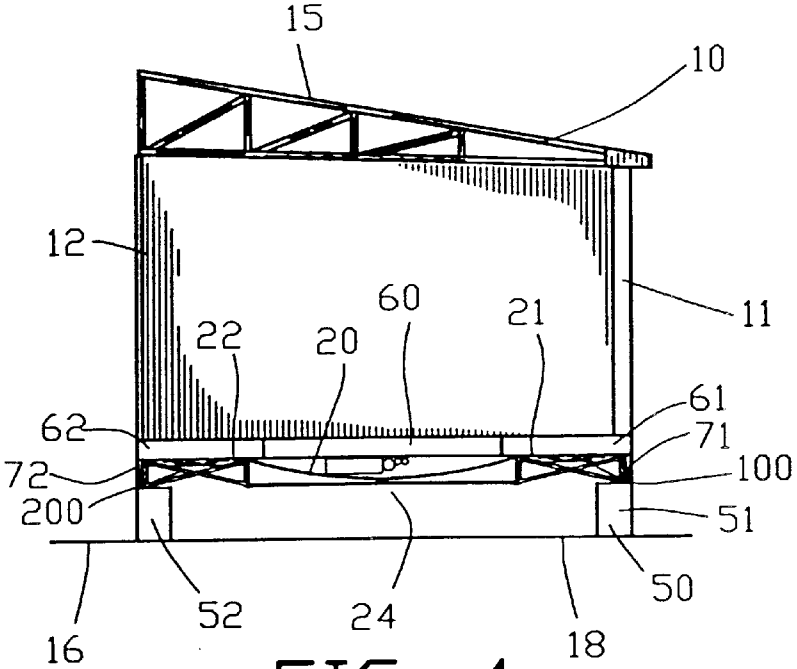
FIG. 4 is an end view of the building structure of FIG. 3 which has been removed from the carrier transport of FIG. 3 and placed upon a piling foundation.

FIG. 4 is an end view similar to FIG. 3 after the building structure 10 has been lifted and placed upon a foundation 50 comprising foundation pilings 51 and 52 on the ground surface 18. The building structure 10 is secured to the foundation pilings 51 and 52 by conventional means which should be well known to those skilled in the art.

The foundation pilings 51 and 52 extend upwardly from the ground surface 16 to space the building structure 10 from the ground surface 16. The foundation pilings 51 and 52 are commonly referred to as piers. The distance of the piers required to space the building structure 10 from the ground surface 16 is regulated by local or federal building codes or regulations.

Figure 5:
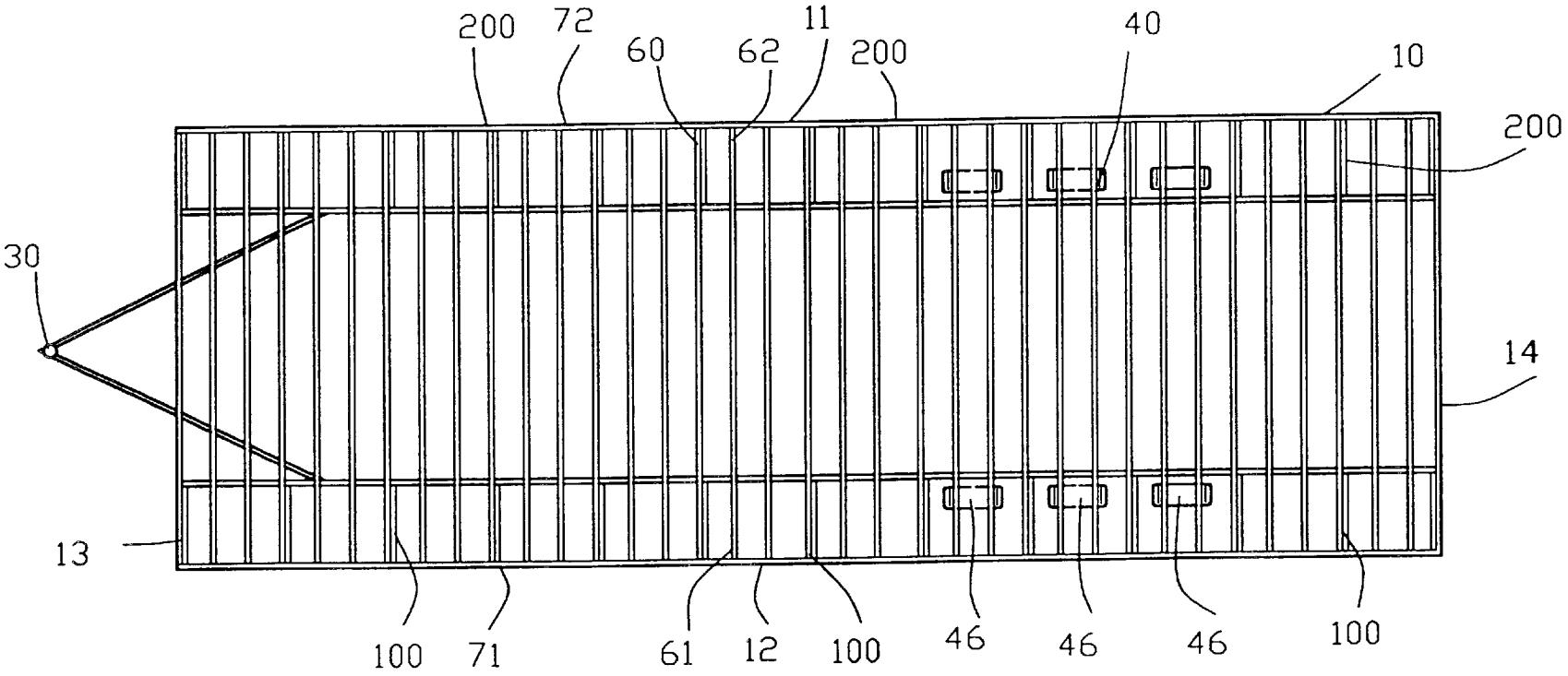
FIG. 5 is a top view of a floor frame of the building structure of FIGS. 1–4 incorporating the outrigger support assembly of the present invention.

FIG. 5 is a top view of a floor frame of the building structure 10 of FIGS. 1–4. The building structure 10 is supported by the longitudinally extending beams 20 shown as the first and second I-beams 21 and 22 constructed of a metallic material. Preferably, the hitch 30 is removably secured to the first and second I-beams 21 and 22. In a similar manner, the plurality of wheel assemblies 40 are removably secured to the first and second I-beams 21 and 22. Upon reaching the building site 18, the hitch 30 and the plurality of wheel assemblies 40 are removed from the first and second I-beams 21 and 22 and the building structure 10 is permanently mounted at the building site 18.

Figure 6:
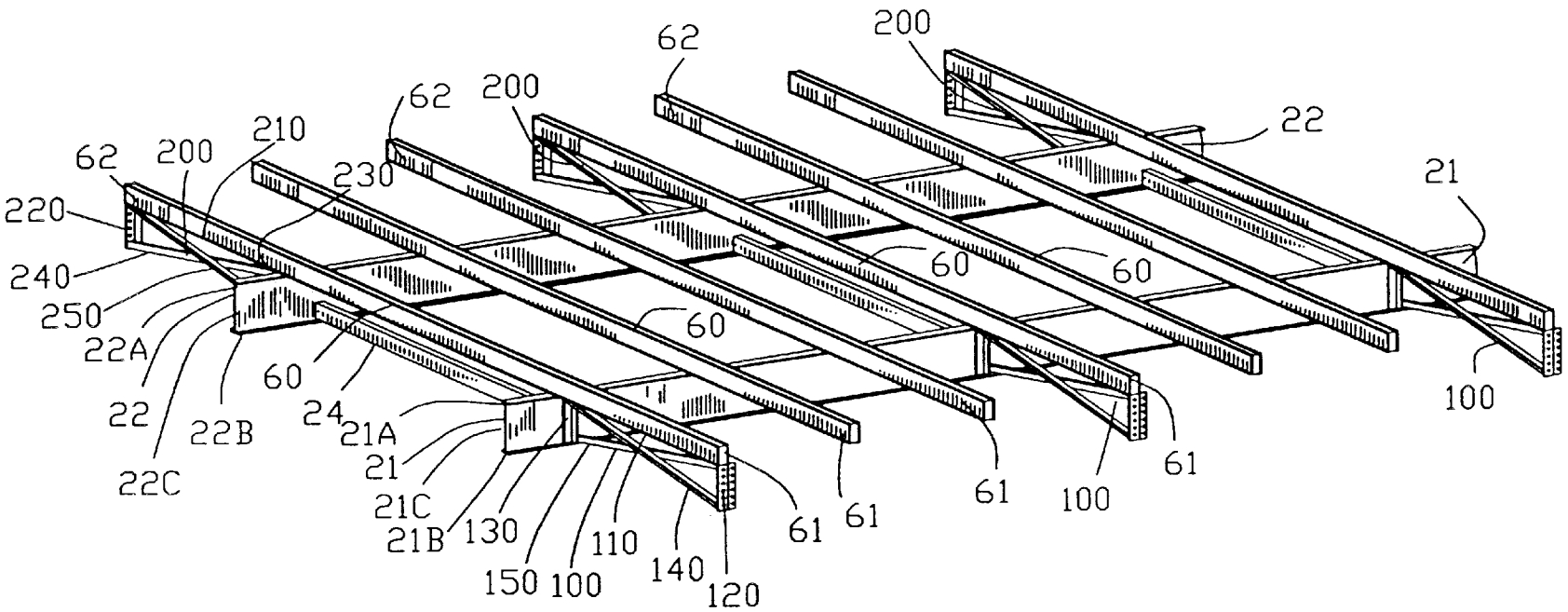
FIG. 6 is an enlarged isometric view of a portion of FIG. 5.

FIG. 6 is an enlarged isometric view of a portion of FIG. 5. The first I-beam 21 comprises 20 an upper horizontal element 21A, a lower horizontal element 21B and an interconnecting vertical element 21C. In a similar manner, the second I-beam 22 comprises an upper horizontal element 22A, a lower horizontal element 22B and an interconnecting vertical element 22C.

The building structure 10 comprises a multiplicity of transverse beams 60 arranged in a substantially parallel relationship. Each of the multiplicity of transverse beams 60 comprises a first and a second end 61 and 62 extending outwardly with the first and second ends 61 and 62 overhanging the first and second longitudinally extending beams 21 and 22.

As best shown in FIGS. 1–4, a first and a second peripheral beam 71 and 72 are respectively connected to the first and second ends 61 and 62 of each of the multiplicity of transverse beams 60. The multiplicity of transverse beams 60 support the floor of the building structure 10 in a conventional manner. Typically, each of the multiplicity of transverse beams 60 is made of a wood material.

One problem encountered with the building structures 10 of the prior art is caused by a deflection or a sagging of one or more of the transverse beams 60. This problem of deflection or sagging of the transverse beam 60 is most critical at the first and second ends 61 and 62 of the transverse beams 60.

As best seen in FIGS. 3 and 4, the first and second ends 61 and 62 of the transverse beams 60 support the walls 11 and 12 and support the roof 15. Furthermore, the first and second ends 61 and 62 of the transverse beams 60 support any load deposited on the roof 15 such as snow, ice or the like.

When the first and second ends 61 and 62 of the transverse beam 60 are deflected downward, the peripheral wall 11 is similarly distorted thereby changing the plumb or level of the building structure 10. In some circumstances, the distortion of the peripheral wall 11 inhibits the opening and closing of either the door 17 and/or the windows 19. To correct this problem of the downward deflection of the first and second ends 61 and 62 of the transverse beam 60, various types of shoring devices were employed by the prior art. The types of shoring devices used is dependent upon the location and the extent of the downward deflection. All of these various types of shoring devices were expensive, time consuming and generally unsatisfactory to the purchaser of the building structure 10.

FIG. 6 is an enlarged isometric view of a portion of FIG. 5 illustrating a first embodiment of the improved outrigger 90 of the present invention for reinforcing the first and second ends 61 and 62 of the transverse beam 60. The improved outrigger support assembly 90 comprises a first and second outrigger 100 and 200 that are mirror images of one another. The building structure has a longitudinally extending I-beam 20. The longitudinally extending I-beam 20 comprises a top portion 21, a bottom portion 22 and an interconnecting portion 23. The top and bottom portions 21 and 22 of the I-beam 20 are substantially horizontal whereas the interconnecting portion 23 of the I-beam 20 is substantially vertical.

The improved outrigger 100 comprises an upper member 100 having a first end 111 and a second end 112. An outer member 120 has a first end 121 and a second end 122 whereas an inner member 130 has a first end 131 and a second end 132. In this embodiment of the invention, the upper member 10, the outer member 120 and the inner member 30 are constructed from steel angle iron.

A first brace 140 has a first end 141 and a second end 142. A second brace 150 has a first end 151 and a second end 152. Preferably, the first and second braces 140 and 150 are steel angle iron.

Figure 11:
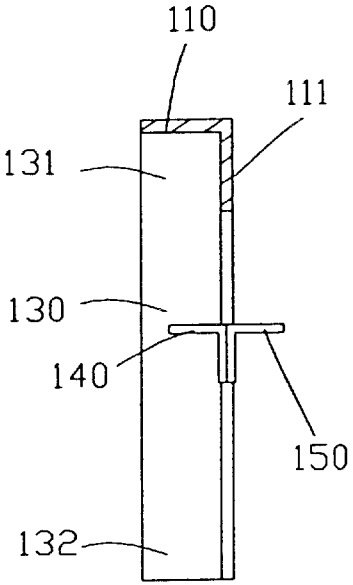
FIG. 11 is a sectional view along line 11—11 in FIG. 8.

The first brace 141 interconnect the first end 131 of the inner member 130 to the lower end 122 of the outer member 120. The second brace 150 interconnects the second end 132 of the inner member 130 to the upper end 121 of the outer member 120. Preferably, the first and second braces 140 and 150 are connected to the inner and outer members 130 and 120 by welding. The first brace 140 is connected to the second brace 150 by a weld 70 as shown in FIG. 11. The inner member 130 is connected to the interconnecting portion 23 of the I-beam 20 by welding 80 or the like.

Figure 7:
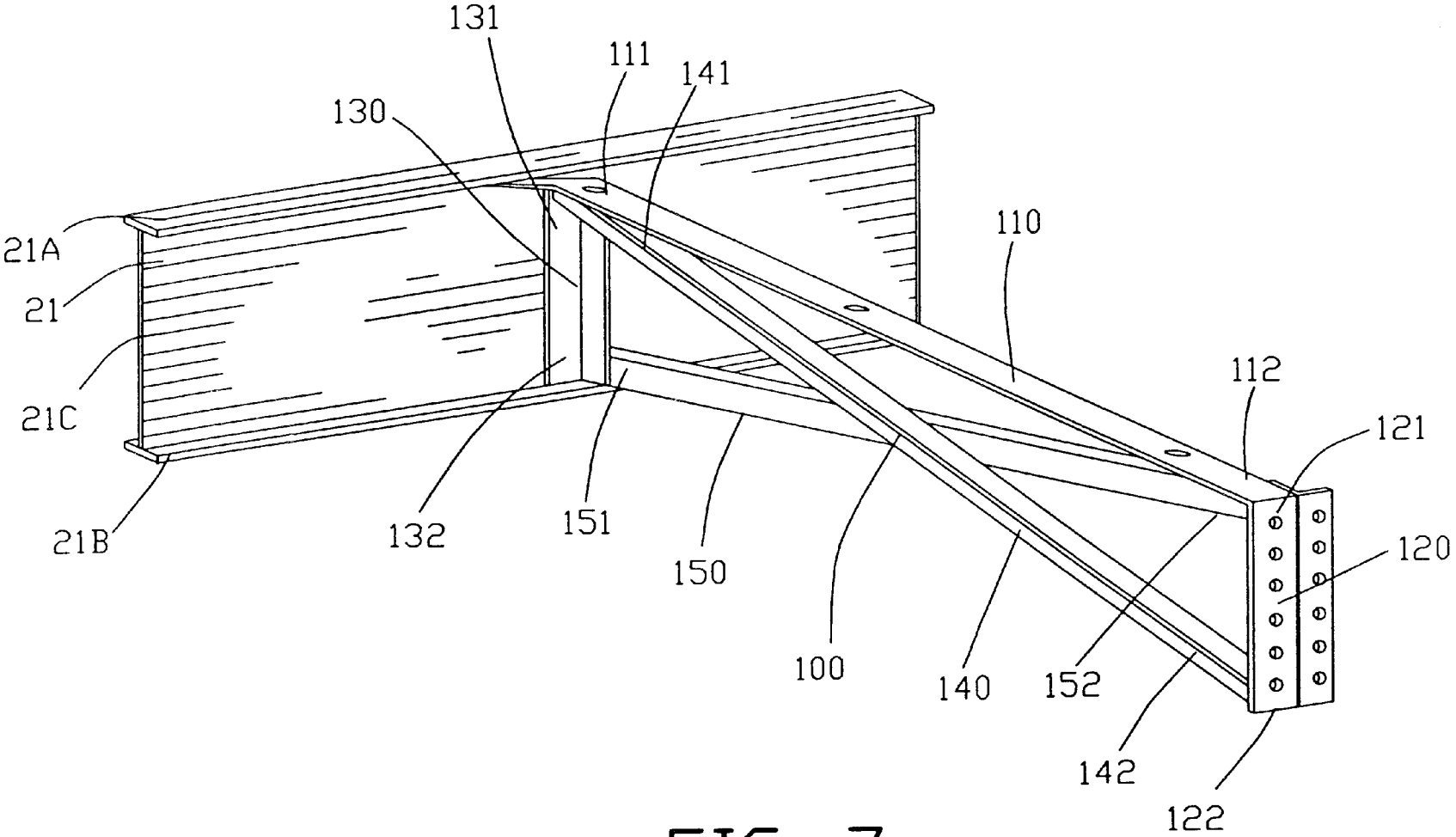
FIG. 7 is an enlarged view of FIG. 6 illustrating the improved outrigger support being secured to a longitudinally extending beam.
Figure 8:
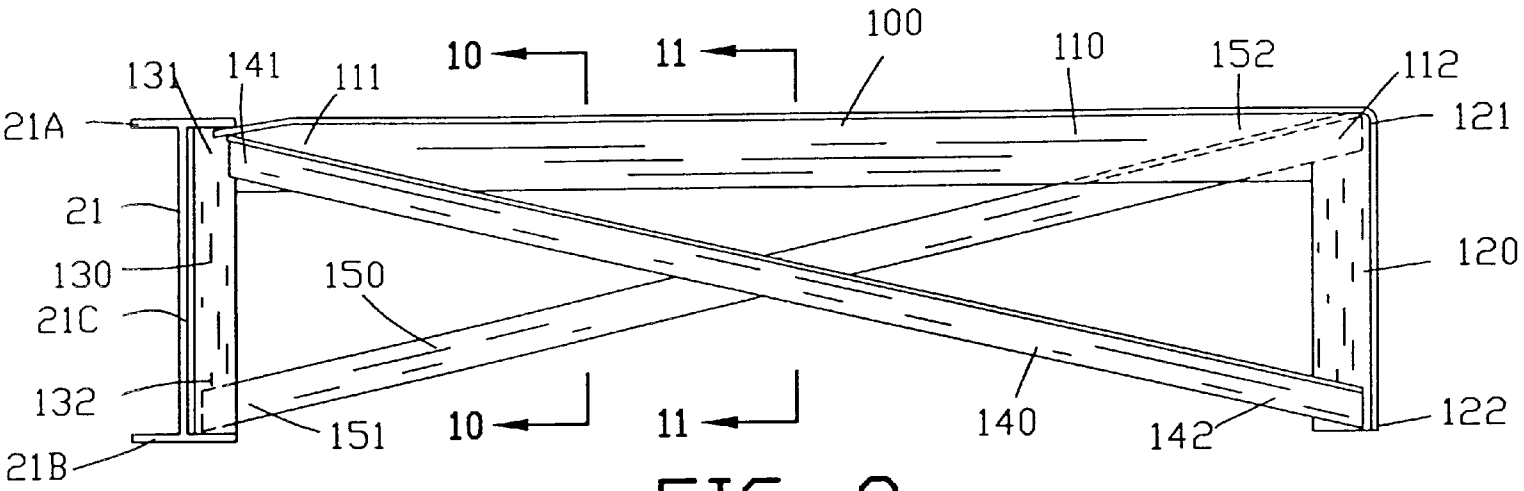
FIG. 8 is a side view of FIG. 7.
Figure 9:
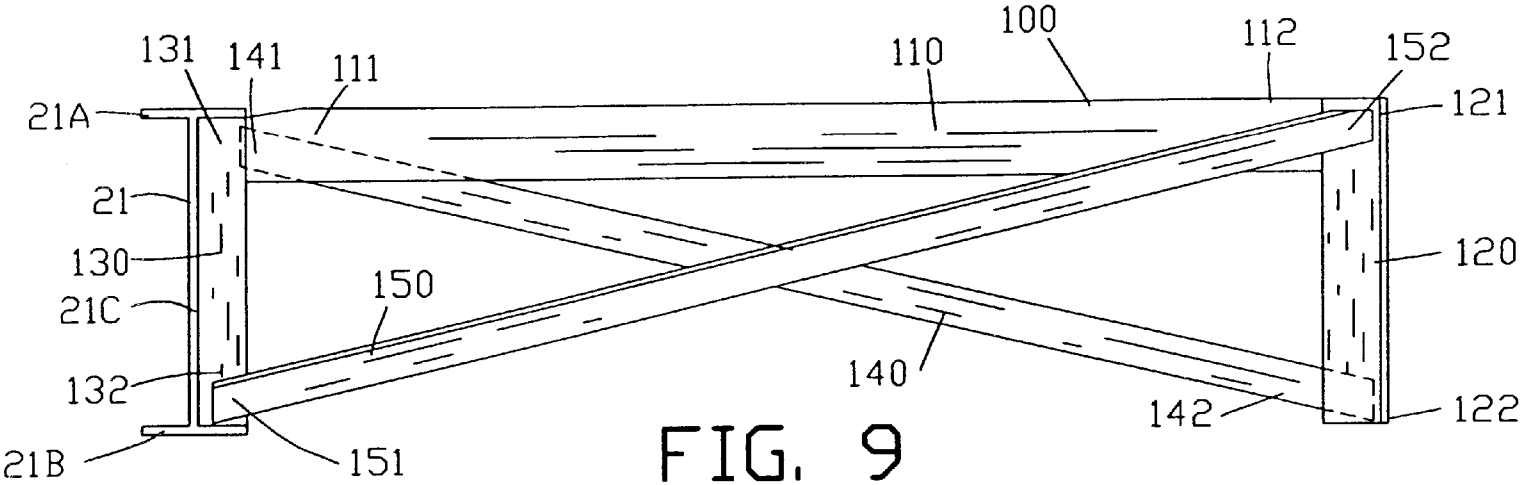
FIG. 9 is a rear view of FIG. 8.
Figure 10:
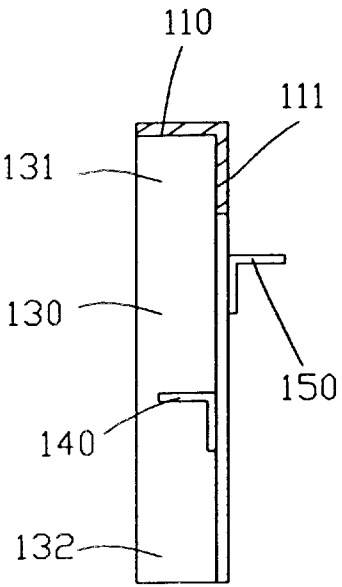
FIG. 10 is a sectional view along line 10—10 in FIG. 8.

FIG. 6 is an enlarged isometric view of a portion of FIG. 5. FIG. 7 is an enlarged end view of FIG. 6 illustrating the improved outrigger support being secured to a longitudinally extending beam. FIG. 8 is a side view of FIG. 7. FIG. 9 is a rear view of FIG. 8. FIG. 10 is a sectional view along line 10—10 in FIG. 8. FIG. 11 is a sectional view along line 11—11 in FIG. 8.

Figure 12:
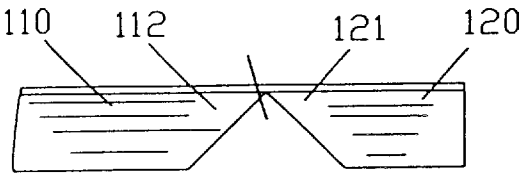
FIG. 12 is an enlarged view of a portion of FIG. 8 illustrating the forming of a notch in an upper member of the outrigger.
Figure 13:
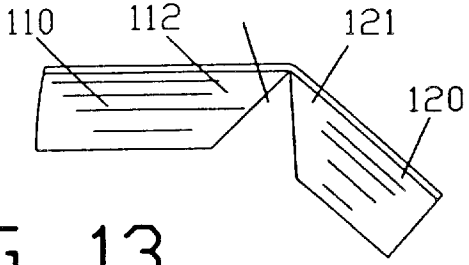
FIG. 13 is a view similar to FIG. 12 illustrating the partial bending of the upper member of the outrigger.
Figure 14:
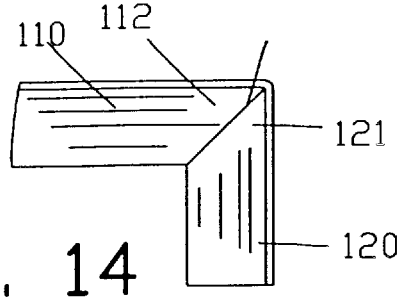
FIG. 14 is a view similar to FIG. 13 illustrating the complete bending of the upper member of the outrigger to form an outer member.

FIG. 12 is an enlarged view of a portion of FIG. 8 illustrating the forming of a notch in an upper member of the outrigger. FIG. 13 is a view similar to FIG. 12 illustrating the partial bending of the upper member of the outrigger. FIG. 14 is a view similar to FIG. 13 illustrating the complete bending of the upper member of the outrigger to form an outer member.

Figure 15:
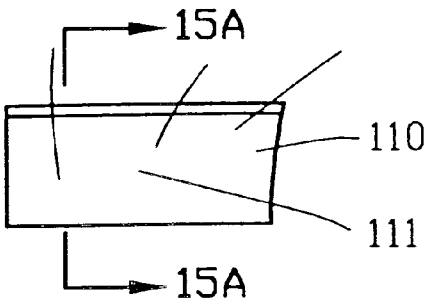
FIG. 15 is an enlarged view of a portion of FIG. 8 illustrating the upper member of the outrigger.
Figure 15A:
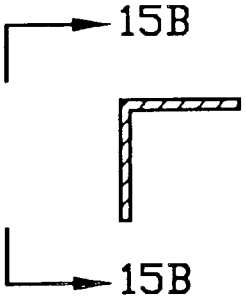
FIG. 15A is a sectional view along line 15A—15A in FIG. 15.
Figure 15B:
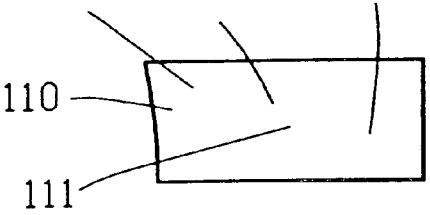
FIG. 15B is a view along line 15B—15B in FIG. 15A.
Figure 16:
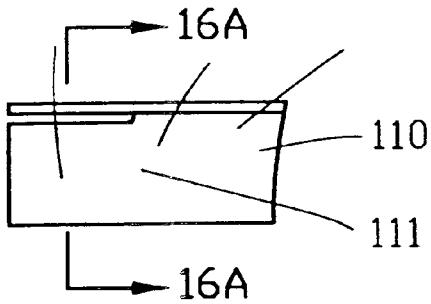
FIG. 16 is a view similar to FIG. 12 illustrating the forming of a slot in the upper member of the outrigger to define a tab.
Figure 16A:
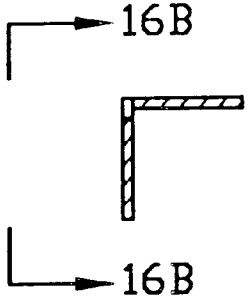
FIG. 16A is a sectional view along line 16A—16A in FIG. 16.
Figure 16B:
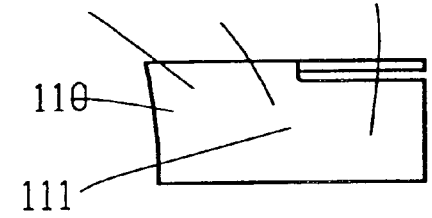
FIG. 16B is a view along line 16B—16B in FIG. 16A.
Figure 17B:
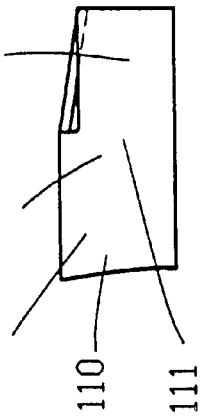
FIG. 17B is a view along line 17B—17B in FIG. 17A.
Figure 17A:
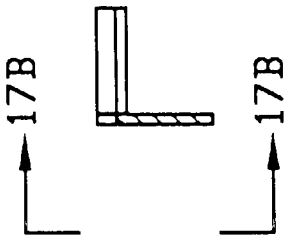
FIG. 17A is a sectional view along line 17A—17A in FIG. 17.
Figure 17:
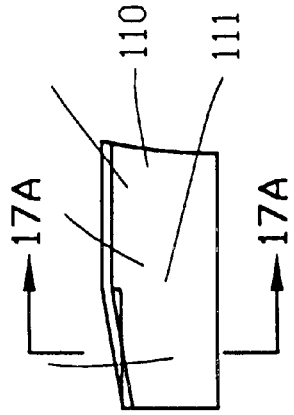
FIG. 17 is a view similar to FIG. 16 illustrating the bending of the tab in the upper member of the outrigger.

FIG. 15 is an enlarged view of a portion of FIG. 8 illustrating the upper member of the outrigger. FIG. 15A is a sectional view along line 15A—15A in FIG. 15. FIG. 15B is a view along line 15B—15B in FIG. 15A. FIG. 16 is a view similar to FIG. 12 illustrating the forming of a slot in the upper member of the outrigger to define a tab. FIG. 16A is a sectional view along line 16A—16A in FIG. 16. FIG. 16B is a view along line 16B—16B in FIG. 16A. FIG. 17 is a view similar to FIG. 16 illustrating the bending of the tab in the upper member of the outrigger. FIG. 17A is a sectional view along line 17A—17A in FIG. 17. FIG. 17B is a view along line 17B—17B in FIG. 17A.

Figure 19:
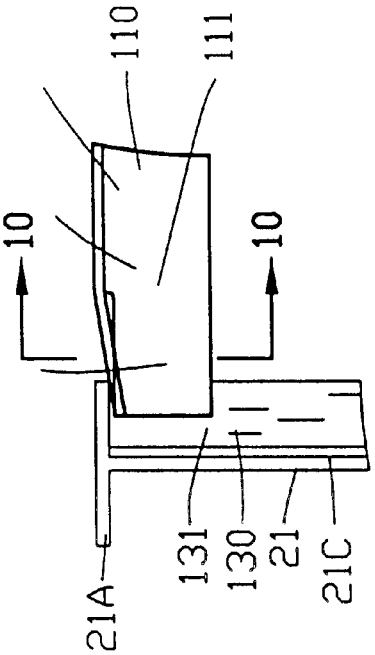
FIG. 19 is a view similar to FIG. 18 illustrating the securing of the upper member and the inner member of the outrigger to the longitudinally extending beam.
Figure 18:
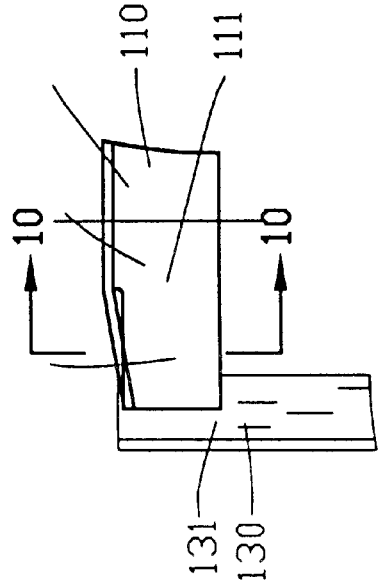
FIG. 18 is a view similar to FIG. 17 illustrating the positioning of the upper member adjacent to an inner member of the outrigger.

FIG. 18 is a view similar to FIG. 17 illustrating the positioning of the upper member adjacent to an inner member of the outrigger. FIG. 19 is a view similar to FIG. 18 illustrating the securing of the upper member and the inner member of the outrigger to the longitudinally extending beam.

Figures 20, 21, 22:
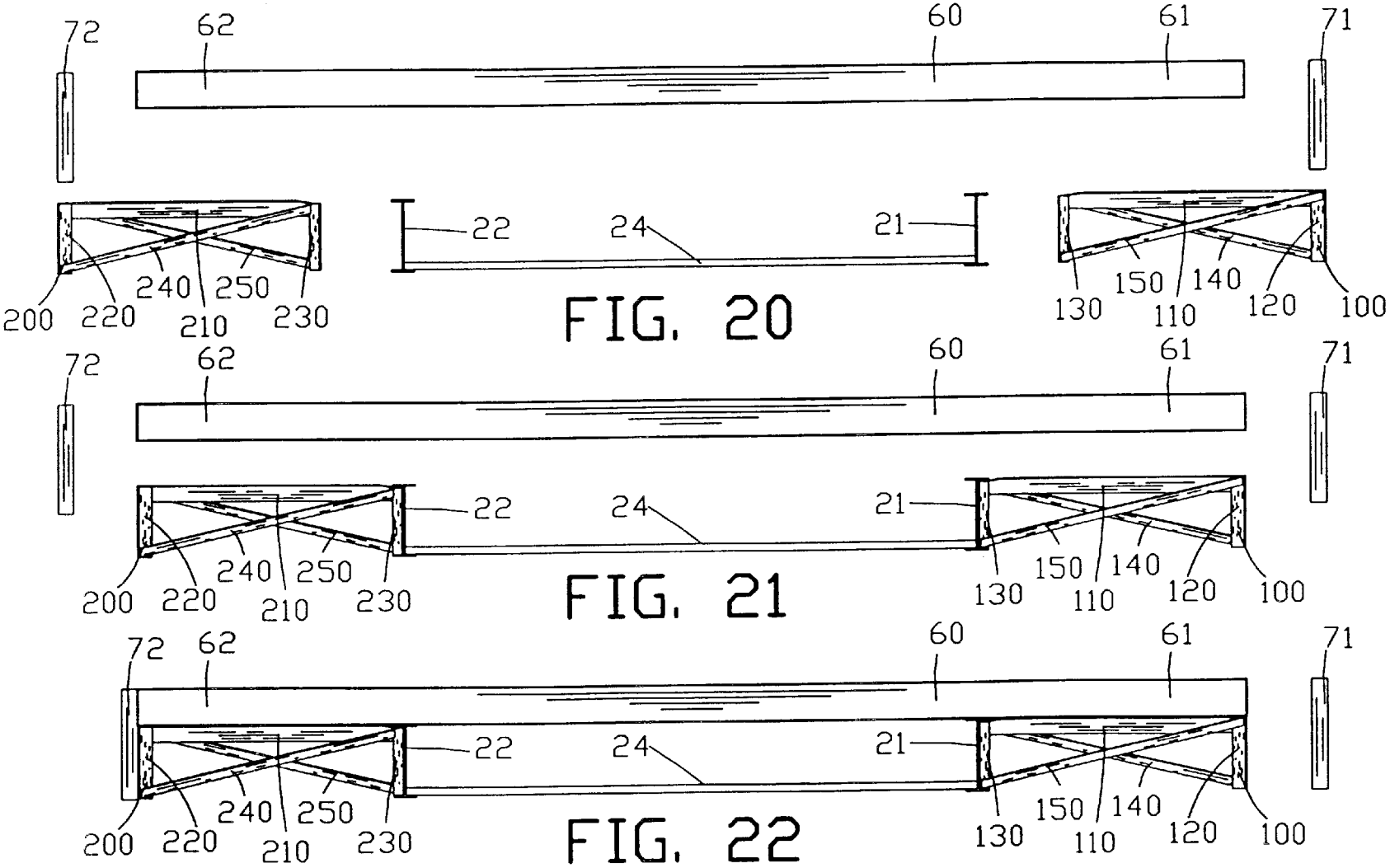
FIG. 20 is an enlarged end view of FIG. 6 illustrating the positioning of a first and second outrigger supports relative to the first and second longitudinally extending beams.
FIG. 21 is a view similar to FIG. 20 illustrating the first and second outrigger supports being secured to the first and second longitudinally extending beams.
FIG. 22 is a view similar to FIG. 21 illustrating the transverse beam being disposed on the first and second longitudinally extending beams and being supported by the first and second outrigger supports.

FIG. 20 is an enlarged end view of FIG. 6 illustrating the positioning of a first and a second outrigger support relative to the first and second longitudinally extending beams. FIG. 21 is a view similar to FIG. 20 illustrating the first and second outrigger supports being secured to the first and second longitudinally extending beams. FIG. 22 is a view similar to FIG. 21 illustrating the transverse beam being disposed on the first and second longitudinally extending beams and being supported by the first and second outrigger supports.

Figure 23:
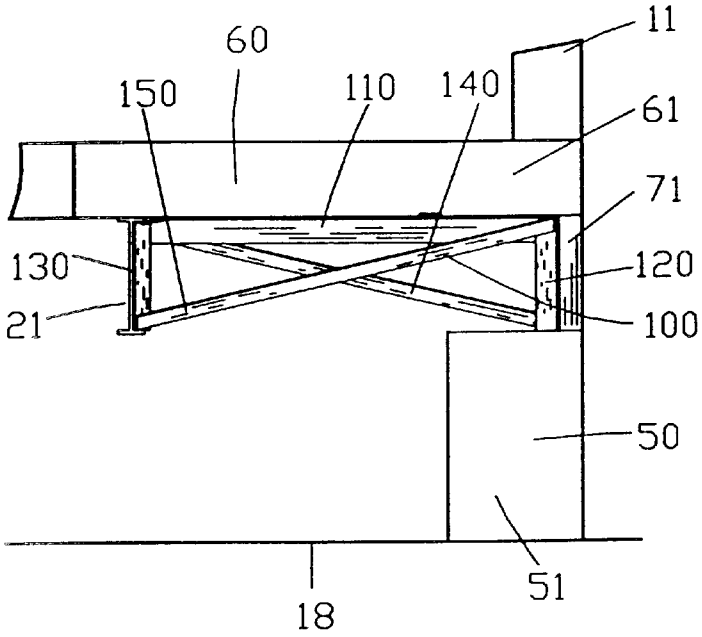
FIG. 23 is a magnified view of a portion of FIG. 4 illustrating the forces applied to the first embodiment of the outrigger support assembly of the present invention.

FIG. 23 is a magnified view of a portion of FIG. 4 illustrating the forces applied to the first embodiment of the outrigger support 100 of the present invention in a first support arrangement. In this arrangement, the outrigger support 100 is supported by the outer member 120 resting upon the foundation pilings 51. A force applied upon the outer member 120 is directly transferred by the outer member 120 to the foundation pilings 51.

A force applied upon the inner member 130 is transferred by the first and second braces 140 and 150 to the foundation pilings 51. The first and second braces 120 and 130 supports the inner member 130 from the foundation pilings 51 through a compressive force applied to the first brace 140 and through a tension force applied to the second brace 150.

Figure 24:
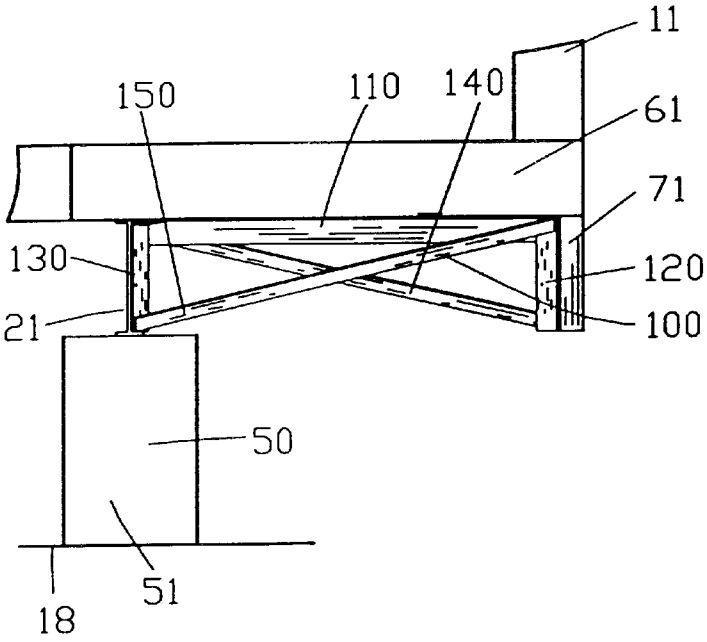
FIG. 24 is a view similar to FIG. 23 illustrating the forces applied to the outrigger in an alternate support arrangement.

FIG. 24 is a magnified view of a portion of FIG. 4 illustrating the forces applied to the first embodiment of the outrigger support 100 of the present invention in a second support arrangement. In this arrangement, the outrigger support 100 is supported by the inner member 130 resting upon the foundation pilings 51. A force applied upon the inner member 130 is directly transferred by the inner member 130 to the foundation pilings 51.

A force applied upon the outer member 120 is transferred by the first and second braces 140 and 150 to the foundation pilings 51. The first and second braces 120 and 130 supports the outer member 130 from the foundation pilings 51 through a tension force applied to the first brace 140 and through a compressive force applied to the second brace 150.

Figure 25:
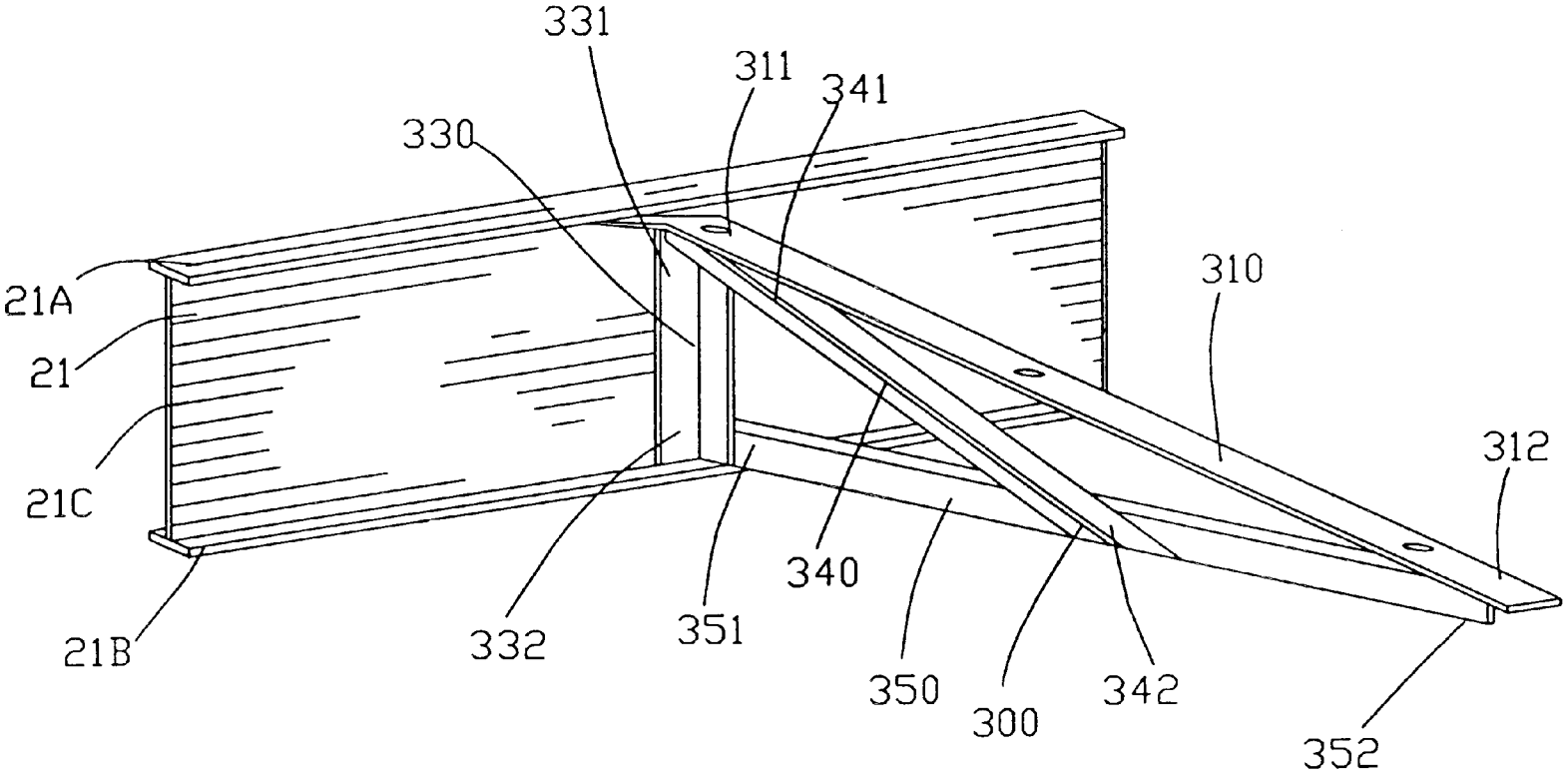
FIG. 25 is an enlarged view illustrating a second embodiment of an improved outrigger support being secured to a longitudinally extending beam.
Figure 26:
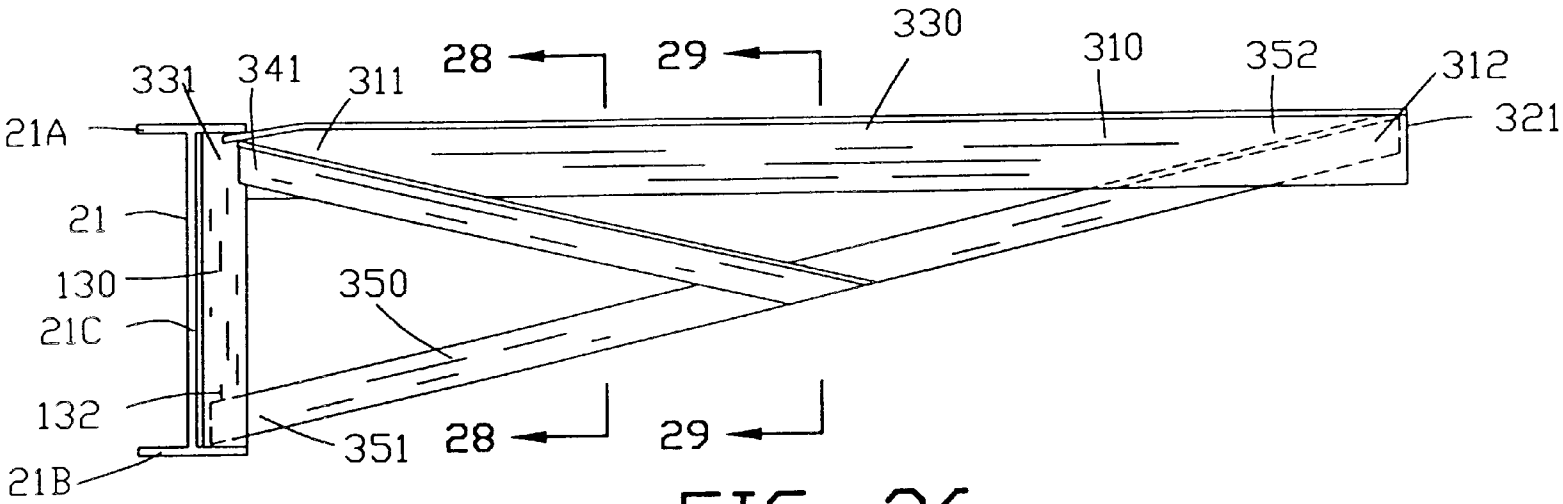
FIG. 26 is a side view of FIG. 25.
Figure 27:
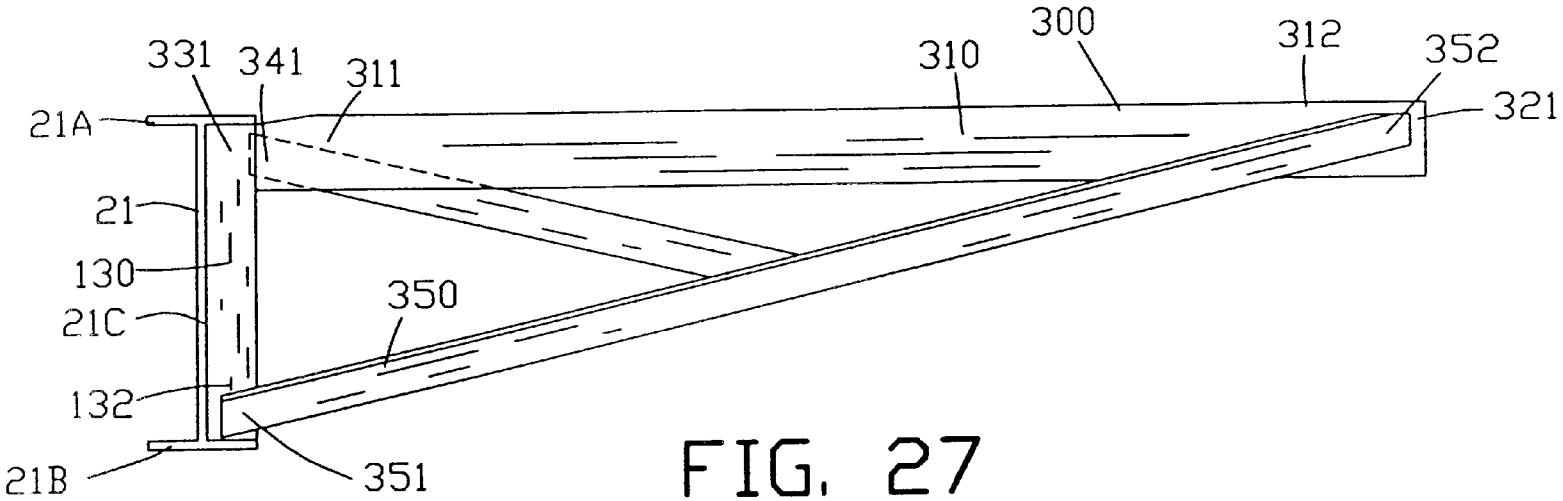
FIG. 27 is a rear view of FIG. 26.
Figure 29:
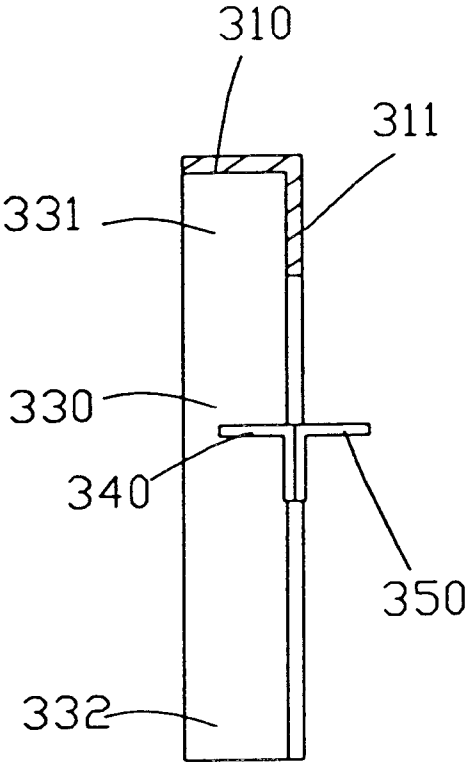
FIG. 29 is a sectional view along line 29—29 in FIG. 26.
Figure 28:
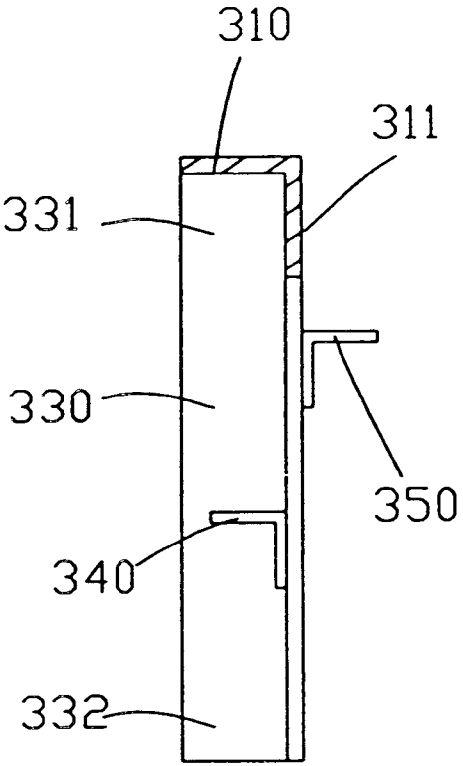
FIG. 28 is a sectional view along line 28—28 in FIG. 26.

FIG. 25 is an enlarged view illustrating a second embodiment of an improved outrigger 300 secured to a longitudinally extending beam. FIG. 26 is a side view of FIG. 25. FIG. 27 is a rear view of FIG. 26. FIG. 28 is a sectional view along line 28—28 in FIG. 26. FIG. 29 is a sectional view along line 29—29 in FIG. 26.

The improved outrigger 300 comprises an upper member 310 having a first end 311 and a second end 312. An inner member 330 has a first end 331 and a second end 332. In this embodiment of the invention, the upper member 310 and the inner member 330 are constructed from steel angle iron.

A first brace 340 has a first end 341 and a second end 342. A second brace 350 has a first end 351 and a second end 352. Preferably, the first and second braces 340 and 350 are steel angle iron.

The second brace 350 interconnects the second end 332 of the inner member 330 to the upper end 321 of the outer member 320. The first brace 341 interconnect the first end 331 of the inner member 330 to the second brace 350.

Preferably, the first and second braces 340 and 350 are connected to the inner members 330 by welding. The first brace 340 is connected to the second brace 350 by a weld 70 as shown in FIG. 29. The inner member 330 is connected to the interconnecting portion 23 of the I-beam by welding 80 or the like.

Figures 30, 31, 32:
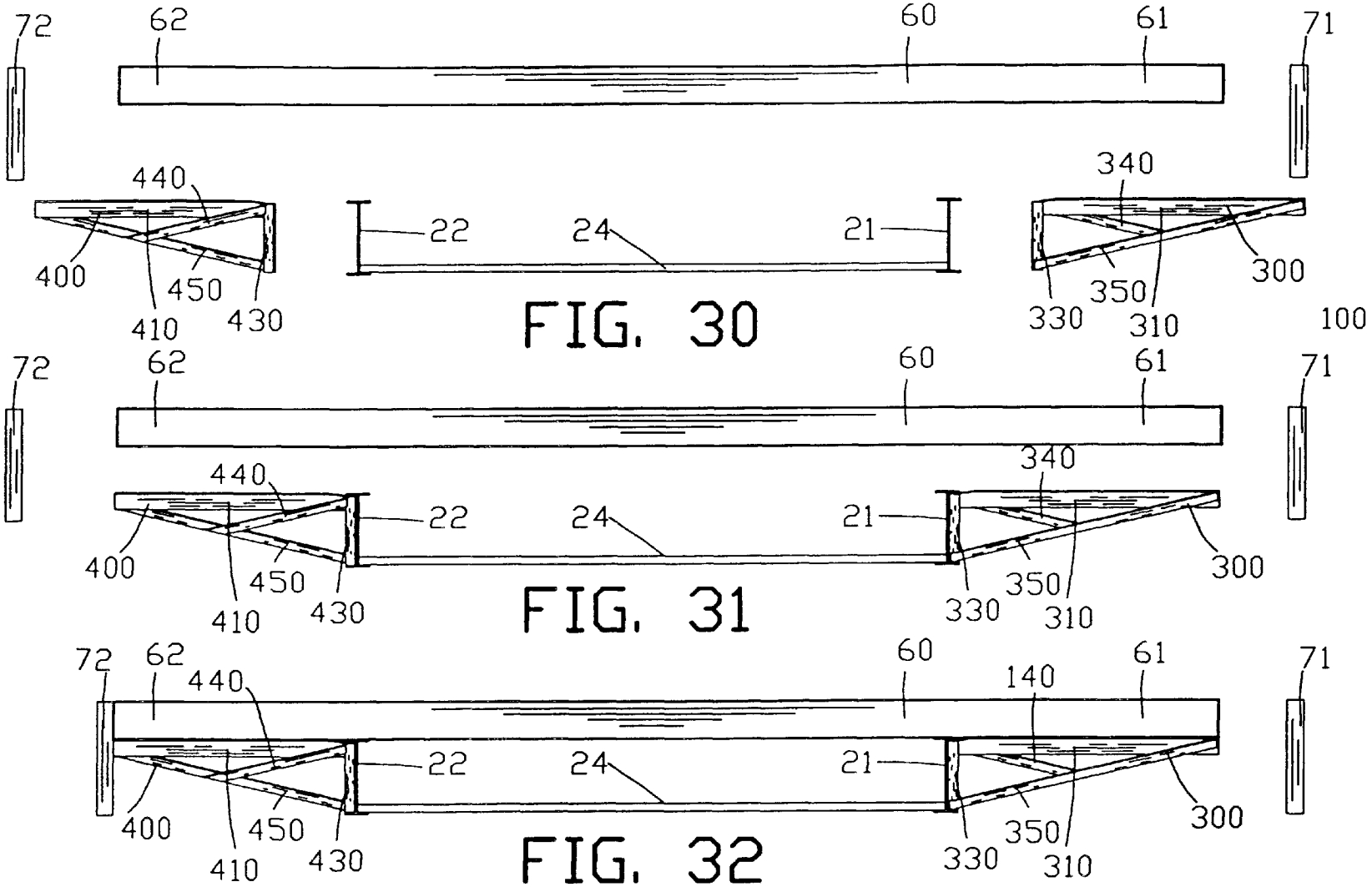
FIG. 30 is an enlarged view of FIG. 25 illustrating the positioning of a first and second outrigger supports relative to the first and second longitudinally extending beams.
FIG. 31 is a view similar to FIG. 30 illustrating the first and second outrigger supports being secured to the first and second longitudinally extending beams.
FIG. 32 is a view similar to FIG. 30 illustrating the transverse beam being disposed on the first and second longitudinally extending beams and being supported by the first and second outrigger supports.

FIG. 30 is an enlarged end view of FIG. 25 illustrating the positioning of a first and a second outrigger support relative to the first and second longitudinally extending beams. FIG. 31 is a view similar to FIG. 30 illustrating the first and second outrigger supports being secured to the first and second longitudinally extending beams. FIG. 32 is a view similar to FIG. 31 illustrating the transverse beam being disposed on the first and second longitudinally extending beams and being supported by the first and second outrigger supports.

Figure 33:
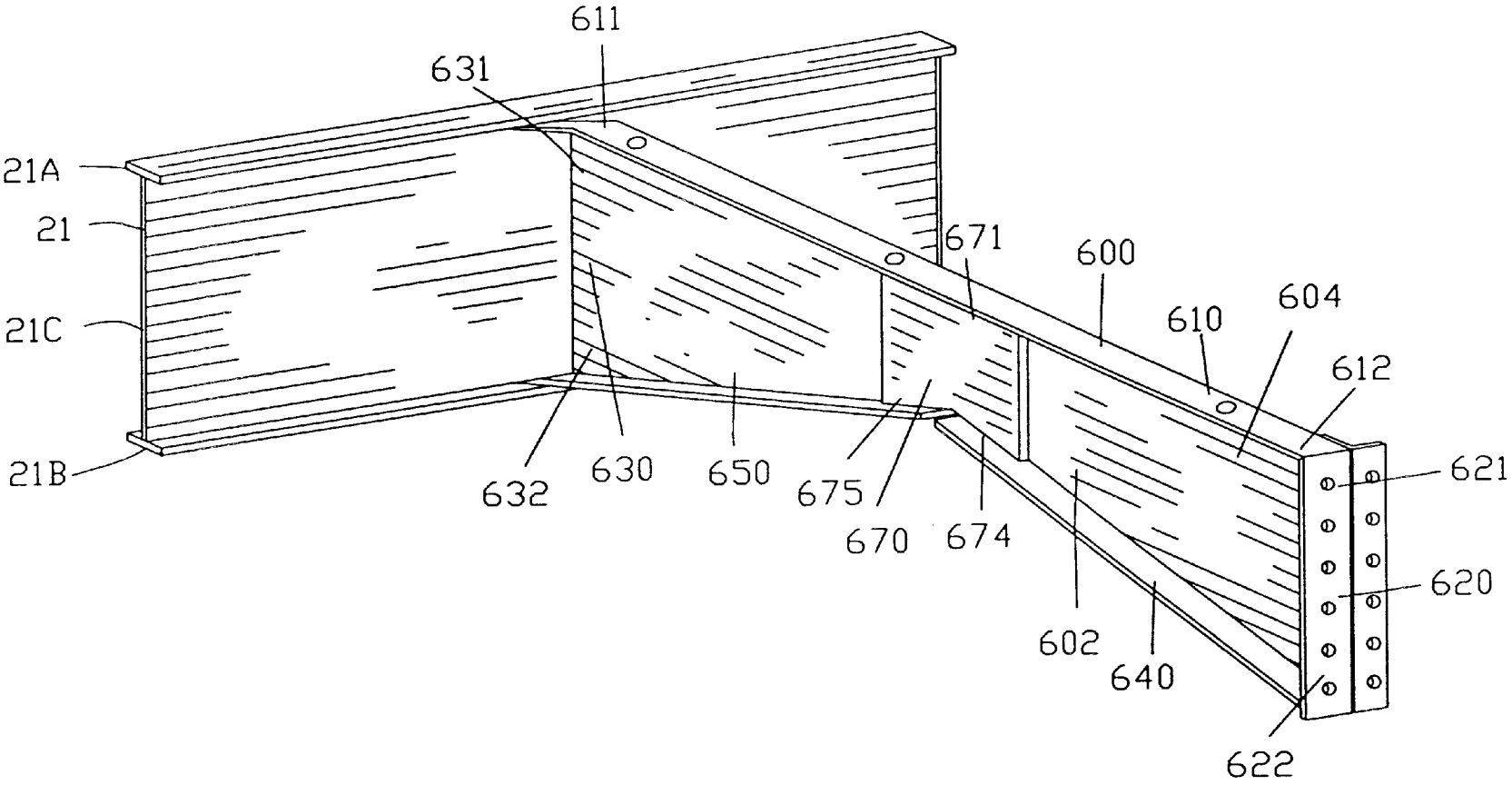
FIG. 33 is a view similar to FIG. 7 illustrating a third embodiment of the invention being secured to a longitudinally extending beam.
Figure 34:
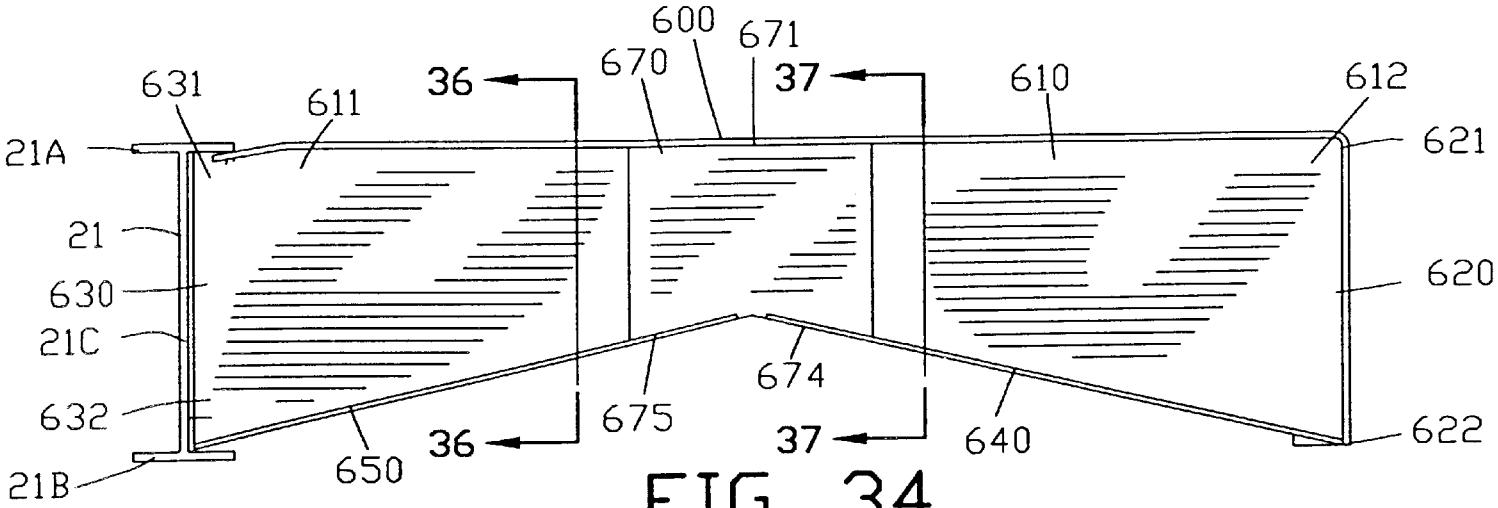
FIG. 34 is a side view of FIG. 33.
Figure 35:
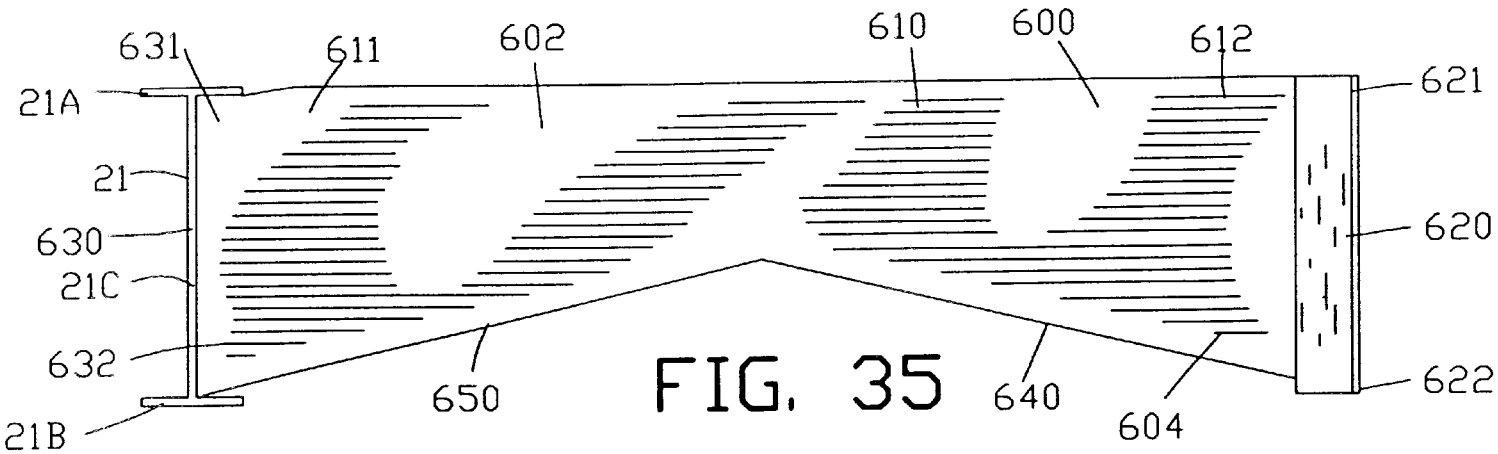
FIG. 35 is a rear view of FIG. 33.
Figure 37:
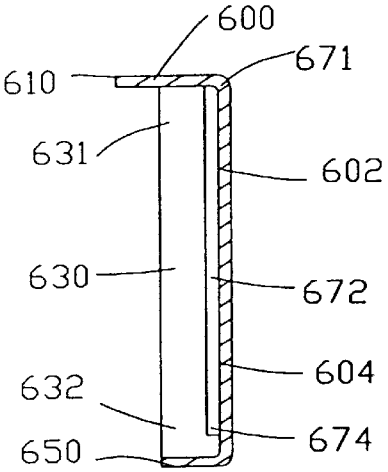
FIG. 37 is a sectional view along line 37—37 in FIG. 34.
Figure 36:
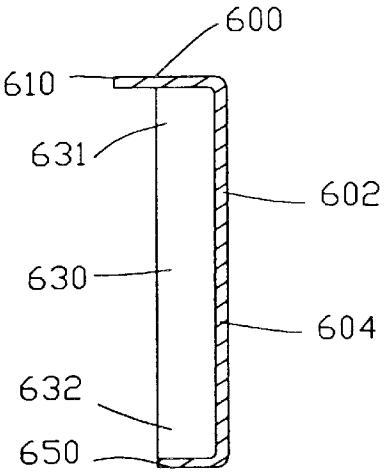
FIG. 36 is a sectional view along line 36—36 in FIG. 34.
Figure 38:
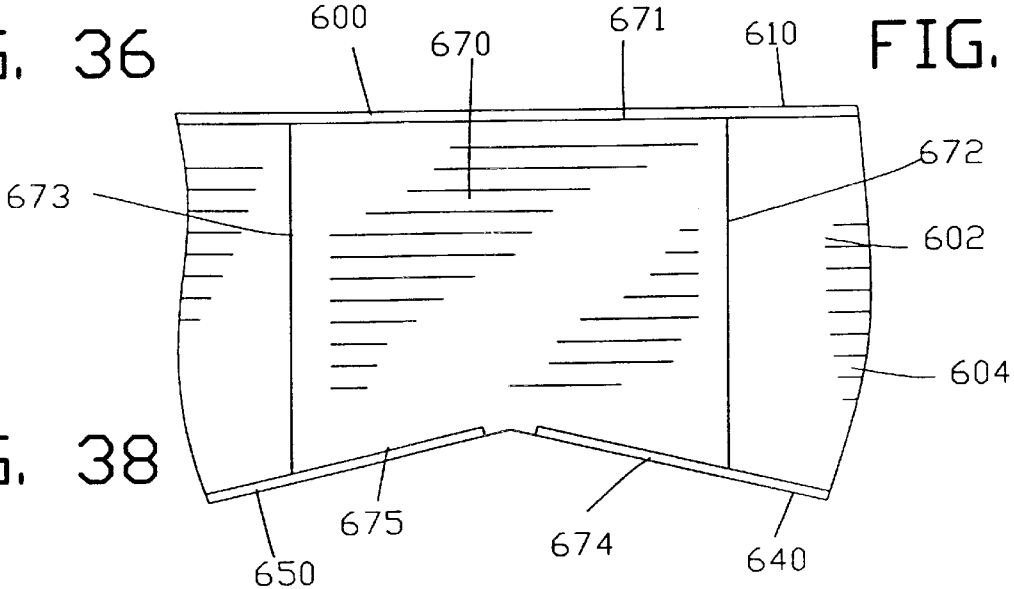
FIG. 38 is a magnified view of a portion of FIG. 34 illustrating a strengthening member.

FIG. 33 is a view similar to FIG. 7 illustrating a third embodiment of the invention being secured to a longitudinally extending beam. FIG. 34 is a side view of FIG. 33. FIG. 35 is a rear view of FIG. 34. FIG. 36 is a sectional view along line 36—36 in FIG. 34. FIG. 37 is a sectional view along line 37—37 in FIG. 34. FIG. 38 is a magnified view of a portion of FIG. 34 illustrating a strengthening member.

In this embodiment, the outrigger 600 comprises an outrigger base 602 comprising a unitary metallic sheet 604. The outrigger base 602 includes an upper rib portion 610, and outer rib portion 620 and inner rib portion 630. A first and a second brace rib portions 640 and 650 are defined at a bottom portion of the outrigger base 602.

The upper rib portion 610 extends substantially across the entire horizontal length of the outrigger base 602. The outer rib portion 620 and the inner rib portion 630 extends substantially across the entire vertical height of the outrigger base 602. The first and second brace rib portions 640 and 650 extend angularly downwardly from an intermediate point at a bottom portion of the outrigger base 602.

The outer rib portion 620 defines a plurality of apertures for affixing an outer peripheral beam thereto as will be described in greater detail hereinafter. An optional secondary outer member may be affixed to the outer rib portion 620 for providing a greater surface area and additional apertures for affixing a peripheral beam. Preferably, the secondary outer member is affixed to the rigger base by suitable means such as welding or mechanical fasteners.

A strengthening member may be affixed to the outrigger base 602 in proximity to the intermediate point. Preferably, the strengthening member 670 comprises an upper end 671, an outer end 672, an inner end 673 and a first and a second lower end 674 and 675. The upper end 671 of the strengthening member 670 engages with the upper rib portion 610. The first and second lower ends 674 and 675 of the strengthening member 670 engage with the first and second brace rib portions 640 and 650 of the outrigger base 602. The outrigger may be affixed to a longitudinally extending I-beam 21 by suitable means such as welding or the like.

Figures 39, 40, 41:
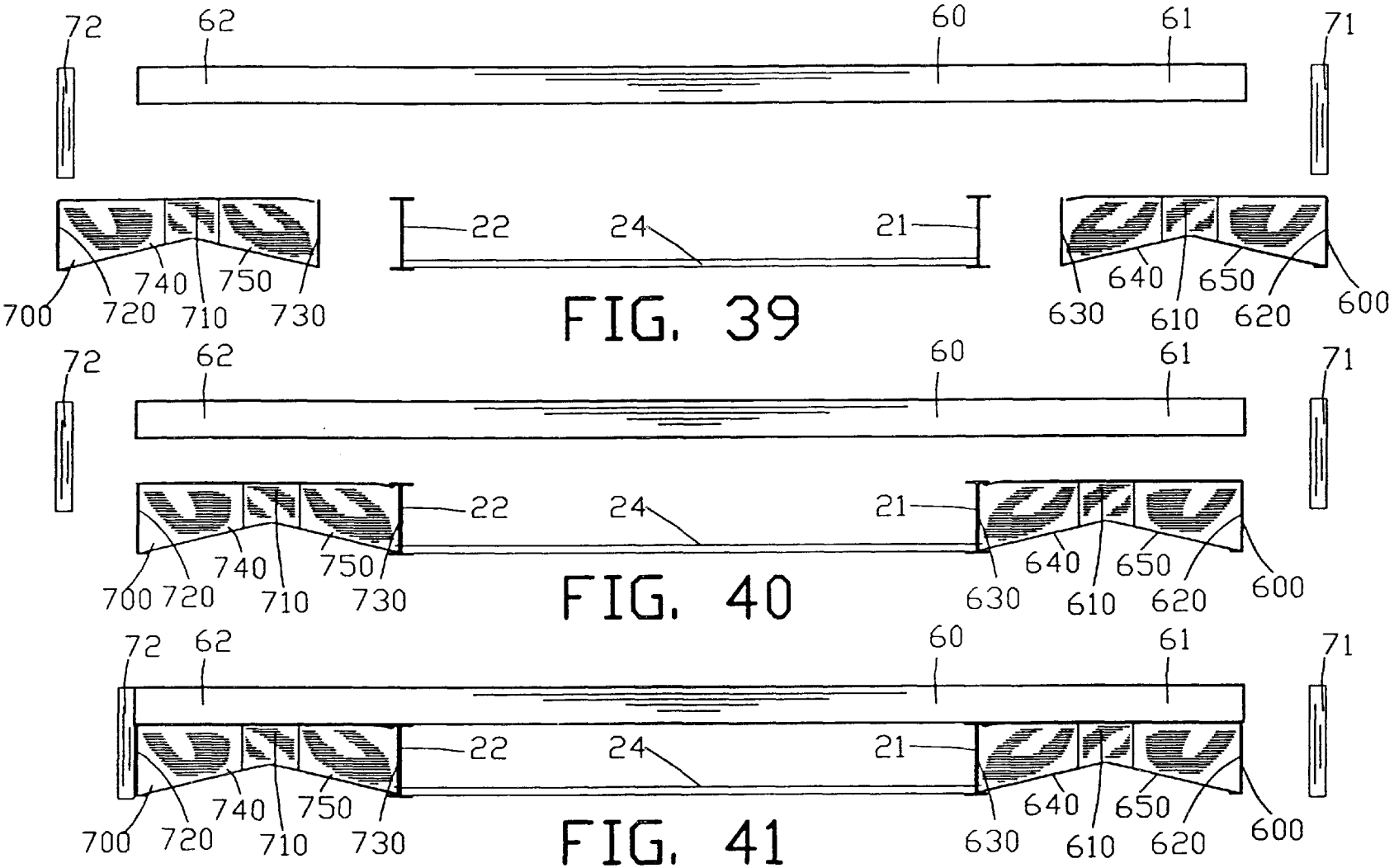
FIG. 39 is an enlarged end similar to FIG. 6 illustrating the positioning of the third embodiment of the first and second outrigger supports relative to the first and second longitudinally extending beams.
FIG. 40 is a view similar to FIG. 39 illustrating the third embodiment of the first and second outrigger supports being secured to the first and second longitudinally extending beams.
FIG. 41 is a view similar to FIG. 40 illustrating the transverse beam being disposed on the first and second longitudinally extending beams and being supported by the third embodiment of the first and second outrigger supports.

FIG. 39 is an enlarged end similar to FIG. 6 illustrating the positioning of a third embodiment of the first and second outrigger supports relative to the first and second longitudinally extending beams. FIG. 40 is a view similar to FIG. 39 illustrating the third embodiment of the first and second outrigger supports being secured to the first and second longitudinally extending beams. FIG. 41 is a view similar to FIG. 40 illustrating the transverse beam being disposed on the first and second longitudinally extending beams and being supported by the second embodiment of the first and second outrigger supports.

Figure 43:
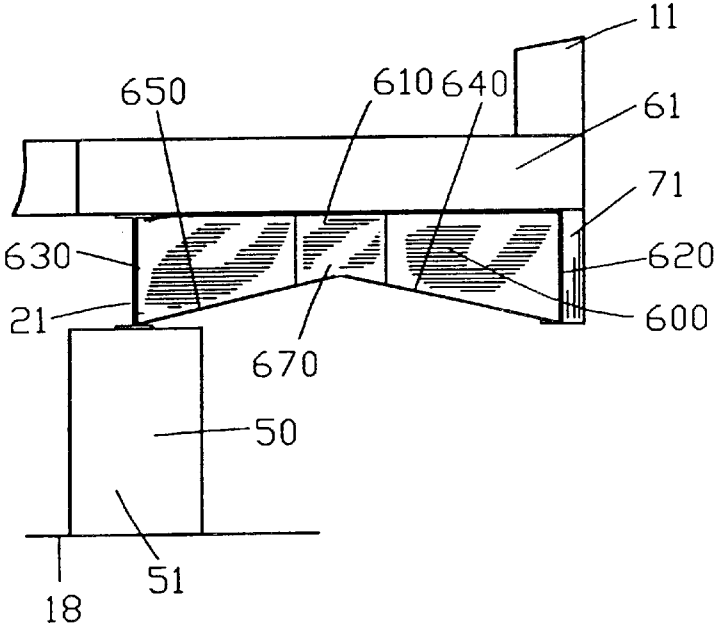
FIG. 43 is a view similar to FIG. 42 illustrating the forces applied to the fourth embodiment of the outrigger support in an alternate support arrangement.
Figure 42:
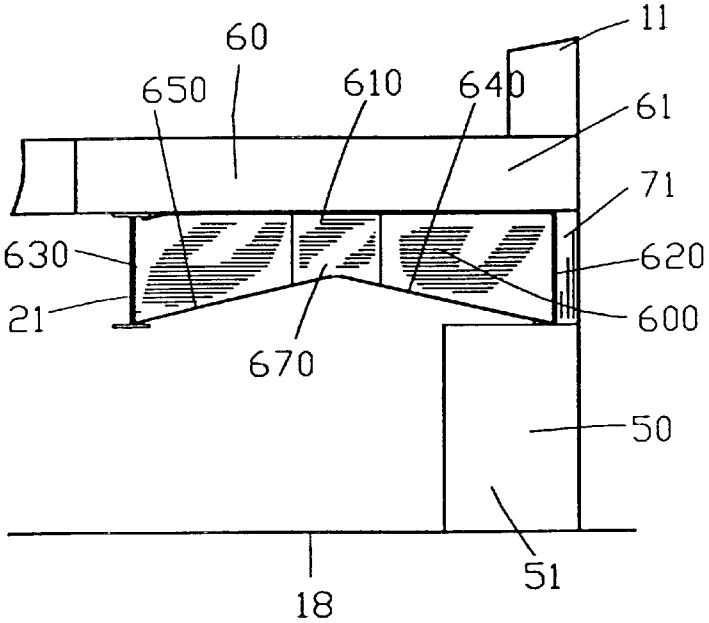
FIG. 42 is a magnified view of a portion of FIG. 4 illustrating the forces applied to the third embodiment of the outrigger support of the present invention.

FIG. 42 is a magnified view of a portion of FIG. 4 illustrating the forces applied to the third embodiment of the outrigger support of the present invention. FIG. 43 is a view similar to FIG. 42 illustrating the forces applied to the third embodiment of the outrigger support in an alternate support arrangement.

Figure 44:
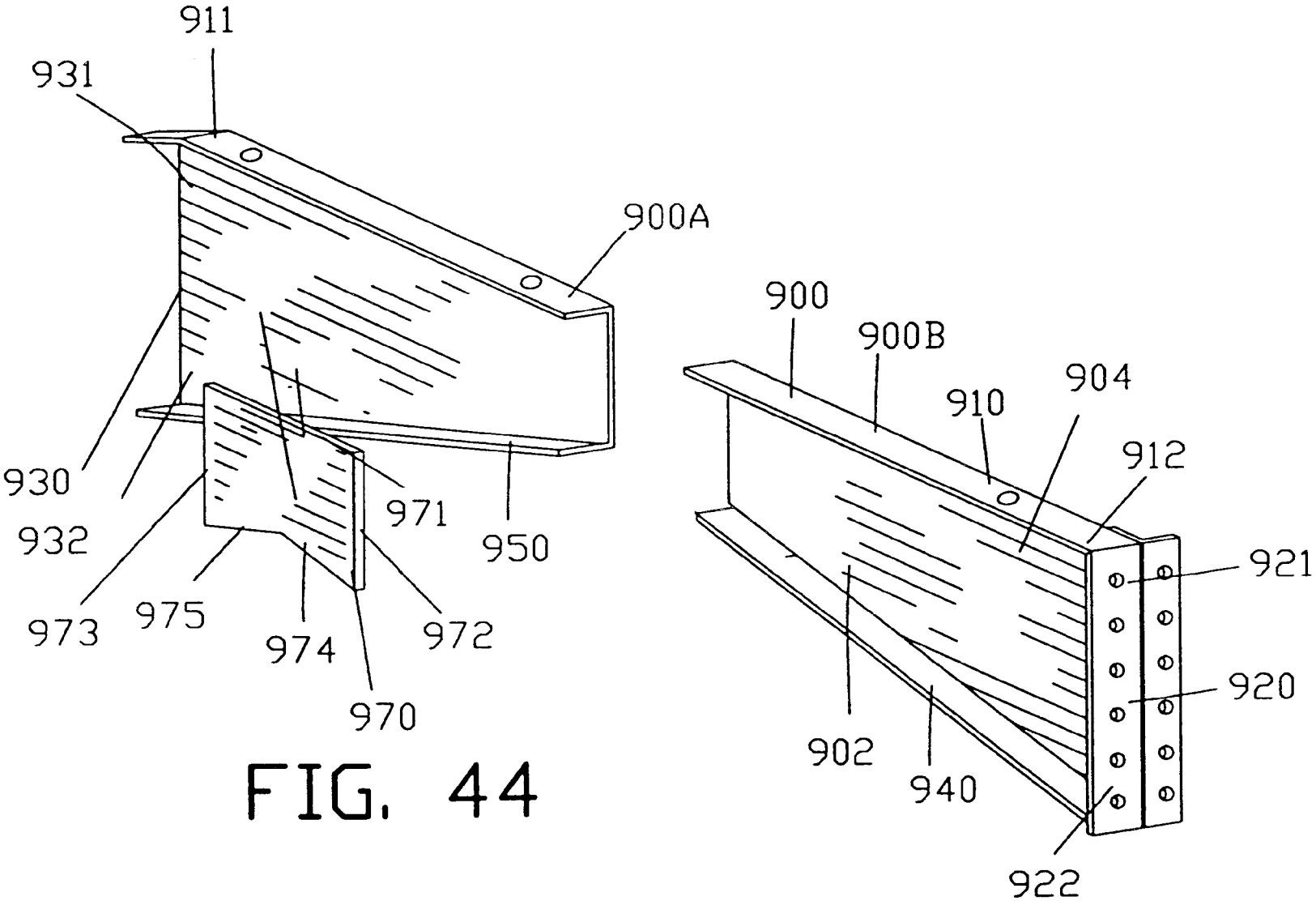
FIG. 44 is an exploded view similar to FIG. 33 illustrating a fourth embodiment of the invention.

FIG. 44 is an exploded view similar to FIG. 33 illustrating a fourth embodiment of the invention. In this embodiment of the invention, the outrigger 900 comprises a first outrigger segment 900A, a second outrigger segment 900B and a strengthening member 970.

Figure 45:
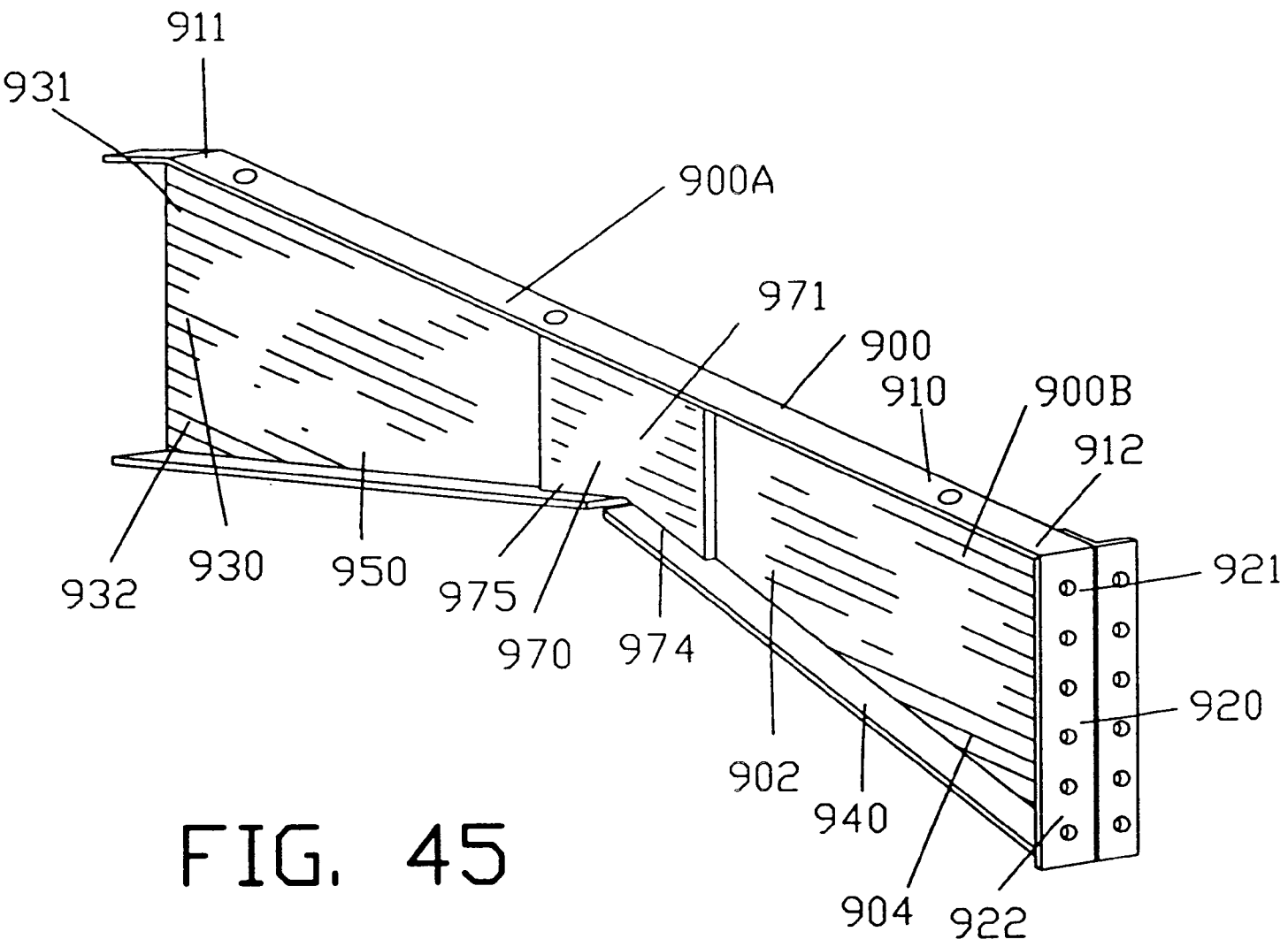
FIG. 45 is an assembled view of the fourth embodiment of the invention of FIG. 44.

FIG. 45 is an assembled view of the fourth embodiment of the invention of FIG. 44. The first outrigger segment 900A is secured to the second outrigger segment 900B by welding the first and second outrigger segments 900A and 900B to the strengthening member 970. The strengthening member 970 reinforces the interconnection between the first outrigger segment 900A and the second outrigger segment 900B.

Figure 46:
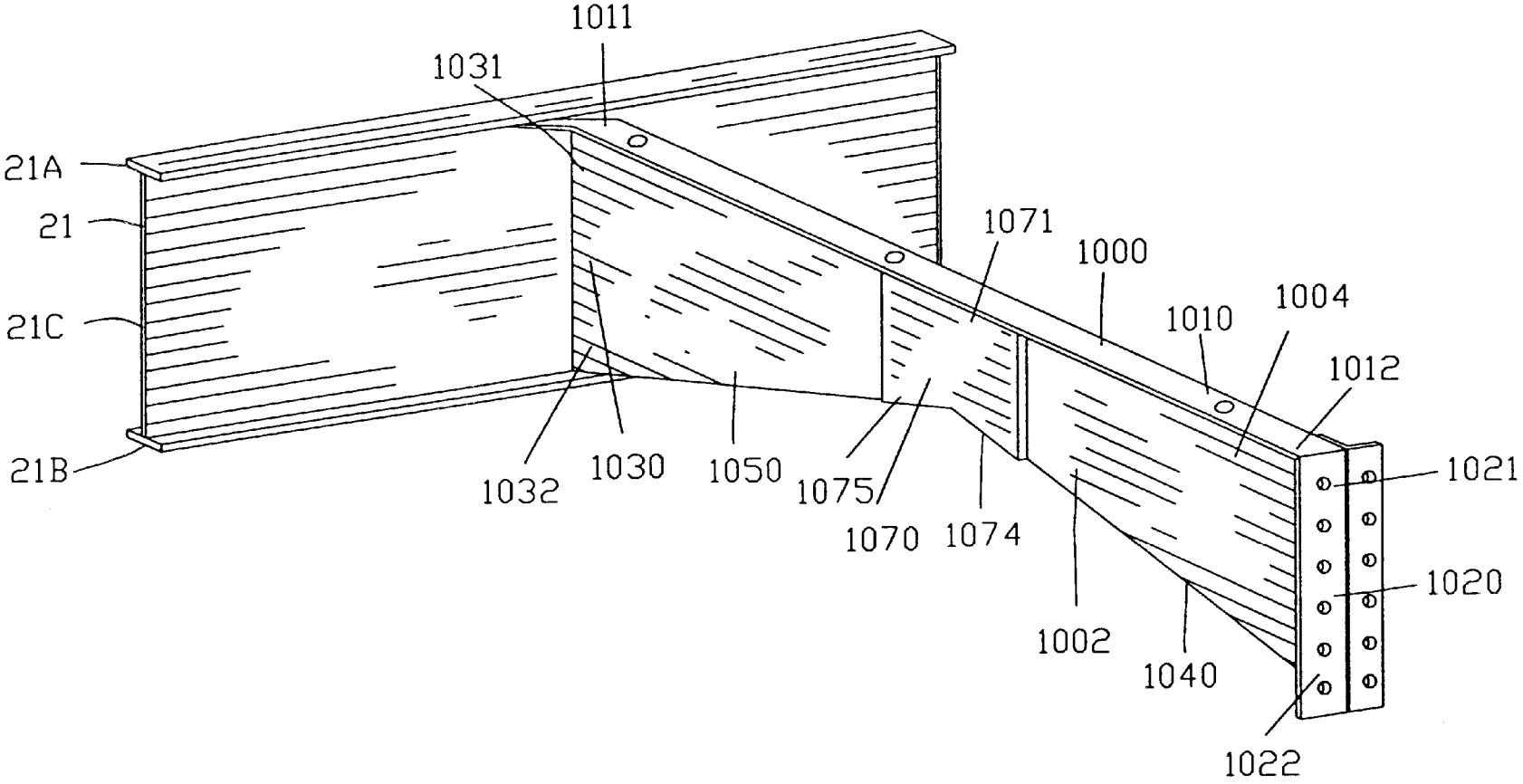
FIG. 46 is a view similar to FIG. 33 illustrating a fifth embodiment of the invention being secured to a longitudinally extending beam.
Figure 47:
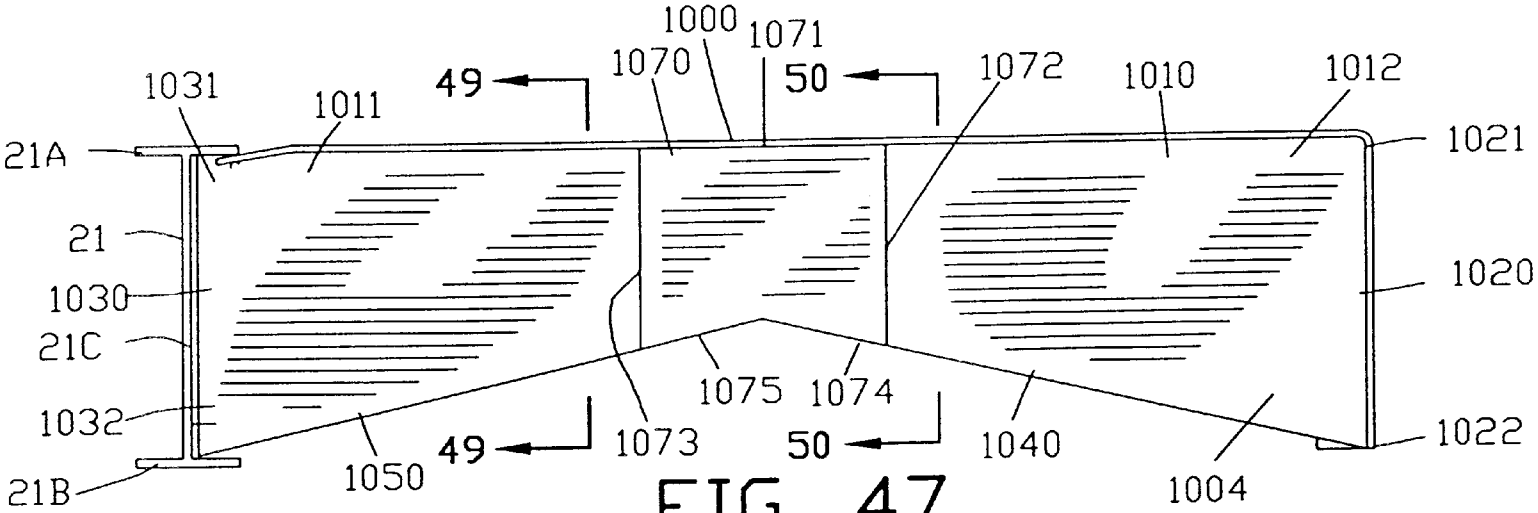
FIG. 47 is a side view of FIG. 46.
Figure 48:
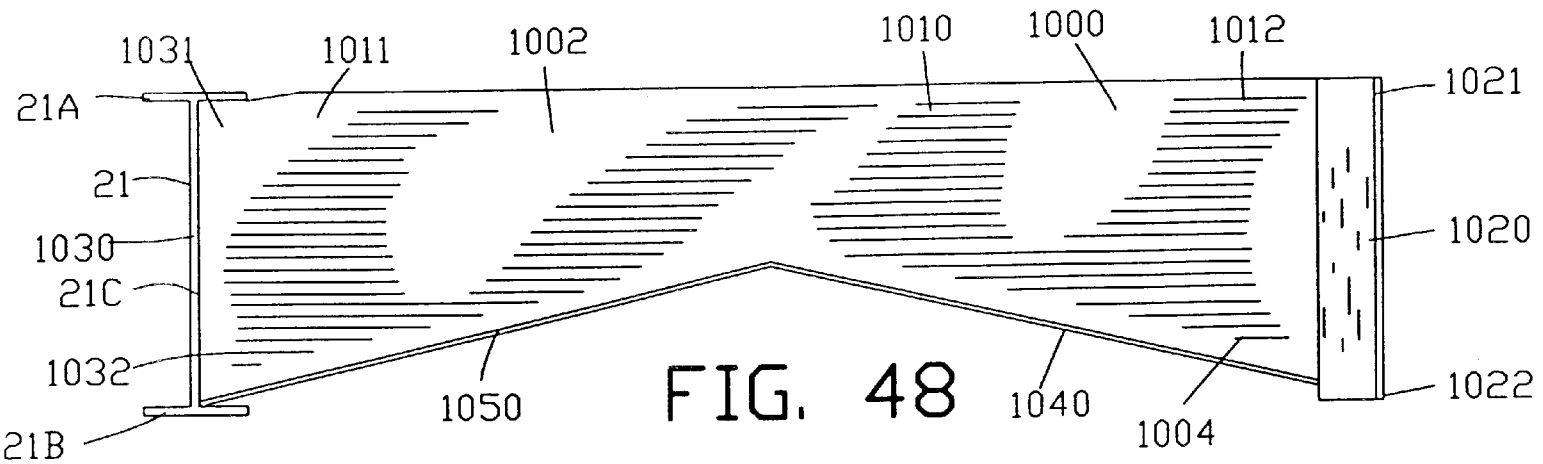
FIG. 48 is a rear view of FIG. 47.
Figure 50:
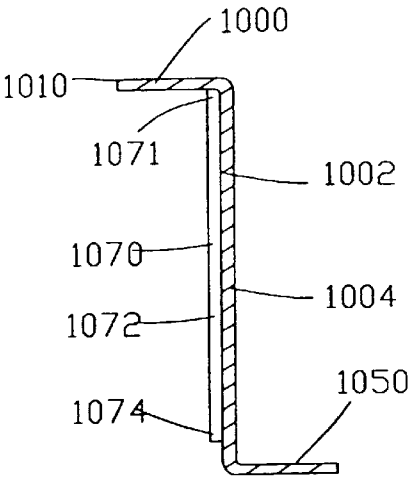
FIG. 50 is a sectional view along line 50—50 in FIG. 47.
Figure 49:
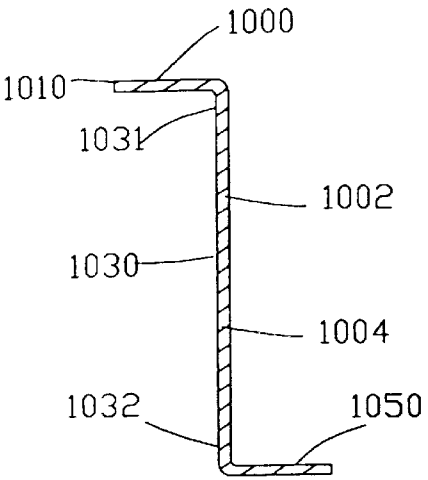
FIG. 49 is a sectional view along line 49—49 in FIG. 48.
Figure 51:
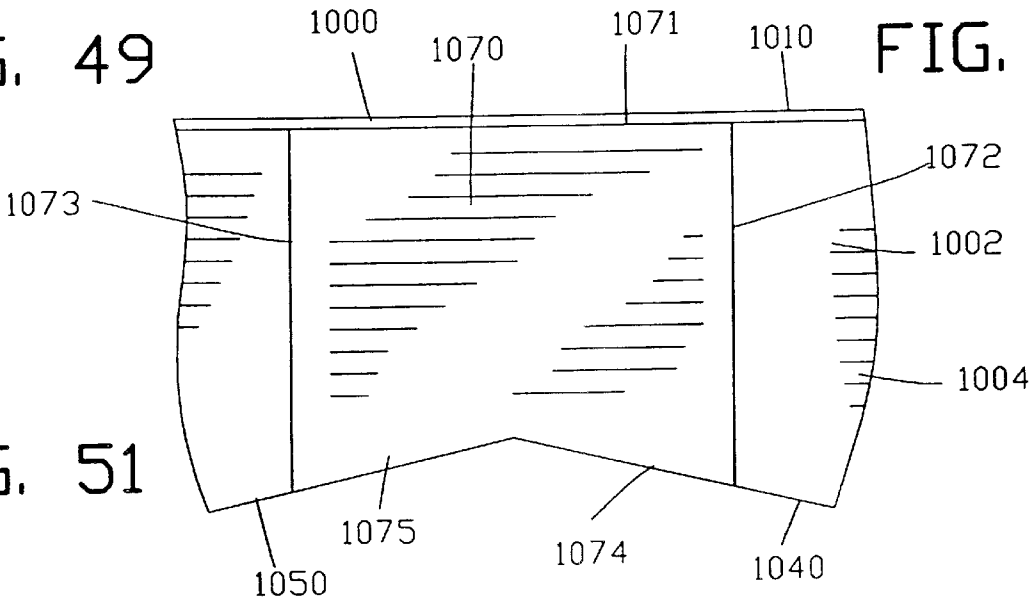
FIG. 51 is a magnified view of a portion of FIG. 47 illustrating a strengthening member.

FIG. 46 is a view similar to FIG. 33 illustrating a fifth embodiment of the invention being secured to a longitudinally extending beam. FIG. 47 is a side view of FIG. 46. FIG. 48 is a rear view of FIG. 47. FIG. 49 is a sectional view along line 49—49 in FIG. 47. FIG. 50 is a sectional view along line 50—50 in FIG. 47. FIG. 51 is a magnified view of a portion of FIG. 47 illustrating a strengthening member.

In this embodiment, the outrigger 1000 comprises an outrigger base 1002 comprising a unitary metallic sheet 1004. The outrigger base 1002 includes an upper rib portion 1010, an outer rib portion 1020 and inner rib portion 1030. A first and a second brace rib portions 1040 and 1050 are defined at a bottom portion of the outrigger base 1002. As best shown in FIGS. 41 and 42, the upper rib portion 1010 extends on one side of the base 1002 whereas the first and second brace rib portions 1040 and 1050 extends on an opposite side of the base 1002.

The upper rib portion 1010 extends substantially across the entire horizontal length of the outrigger base 1002. The outer rib portion 1020 and the inner rib portion 1030 extends substantially across the entire vertical height of the outrigger base 1002. The first and second brace rib portions 1040 and 1050 extend angularly downwardly from an intermediate point at a bottom portion of the outrigger base 1002.

The outer rib portion 1020 defines a plurality of apertures for affixing an outer peripheral beam thereto as will be described in greater detail hereinafter. An optional secondary outer member may be affixed to the outer rib portion 1020 for providing a greater surface area and additional apertures for affixing a peripheral beam. Preferably, the secondary outer member is affixed to the rigger base by suitable means such as welding or mechanical fasteners.

A strengthening member may be affixed to the outrigger base 1002 in proximity to the intermediate point. Preferably, the strengthening member 1070 comprises an upper end 1071, an outer end 1072, an inner end 1073 and a first and a second lower end 1074 and 1075. The upper end 1071 of the strengthening member 1070 engages with the upper rib portion 1010. The outrigger may be affixed to a longitudinally extending I-beam 21 by suitable means such as welding or the like.

Although the invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved outrigger connected to a longitudinally extending I-beam of a building structure, the longitudinally extending I-beam having a horizontally extending top portion and a horizontally extending bottom portion with the top portion being joined to the bottom portion by a vertically extending interconnecting portion, comprise:

an outer member having an upper end and a lower end;

first brace connected to the horizontally extending bottom portion of the longitudinally extending I-beam and said to upper end of said outer member;

a second brace connected to the horizontally extending top portion of the longitudinally extending I-beam and to said lower end of said outer member;

means connecting said first brace to said second brace; and said first and second braces being connected to the longitudinally extending I-beam between the top and bottom portions thereof.

2. An improved outrigger as set forth in claim 1, wherein said outer member is a steel angle.

3. An improved outrigger set forth in claim 1, wherein said first and second braces are steel angles.

4. An improved outrigger as set forth in claim 1, wherein said first and second braces are interconnected by welding.

5. An improved outrigger connected to a longitudinally extending I-beam of a building structure, the longitudinally extending I-beam having a horizontally extending top portion and a horizontally extending bottom portion with the top portion being joined to the bottom portion by a vertically extending interconnecting portion, comprising:

an outer member having an upper end and a lower end;

first brace connected to the horizontally extending bottom portion of the longitudinally extending I-beam and to said upper end of said outer member;

a second brace connected to the horizontally extending top portion of the longitudinally extending I-beam and to said lower end of said outer member;

means connecting said first brace to said second brace; and said first and second braces being connected to the I-beam and said outer member by welding.

6. An improved outrigger connected to a longitudinally extending I-beam of a building structure, the longitudinally extending I-beam having a horizontally extending top portion and a horizontally extending bottom portion with the top portion being joined to the bottom portion by a vertically extending interconnecting portion, comprising:

an inner member having an upper end and a lower end;

an outer member having an upper end and a lower end;

first brace extending between said lower end of said inner member and said upper end of said outer member;

a second brace extending between said upper end of said inner member to said lower end of said outer member;

means connecting said first brace to said second brace; and means for connecting said inner member to said I-beam between the and bottom portions of the I-beam.

7. An improved outrigger assembly connected to a metallic I-beam of a building structure, the metallic I-beam having a horizontally extending top portion and a horizontally extending bottom portion with the top portion being joined to the bottom portion by a vertically extending interconnecting portion, the improved outrigger assembly comprising:

an inner member having an upper end and a lower end;

said inner member being formed from a metallic angle member;

an outer member having an upper end and a lower end;

said outer member being formed from a metallic angle member;

an upper member having an inner end and an outer end;

means connecting said inner end of said upper member to said upper end of said inner member to form an inner junction;

means connecting said outer end of said upper member to said upper end of said outer member to form an outer junction;

a first and a second brace;

said first brace interconnecting said lower end of said inner member to said outer junction;

said second brace interconnecting said inner junction to said lower end of said outer member;

means connecting said first brace to said second brace intermediate said inner member and said outer member; and means for connecting said inner member to said interconnecting portion of the I-beam with said upper and lower ends of said inner member being located between the top and bottom portions of the I-beam for connecting the improved outrigger assembly to the metallic I-beam of the building structure.

8. An improved outrigger assembly connected to a metallic I-beam of a building structure, the metallic I-beam having a horizontally extending top portion and a horizontally extending bottom portion with the top portion being joined to the bottom portion by a vertically extending interconnecting portion, the improved outrigger assembly comprising:

an inner member having an upper end and a lower end;

an outer member having an upper end and a lower end;

an upper member having an inner end and an outer end;

means connecting said inner end of said upper member to said upper end of said inner member to form an inner junction;

means connecting said outer end of said upper member to said upper end of said outer member to form an outer junction;

a first and a second brace;

said first brace interconnecting said lower end of said inner member to said outer junction;

said second brace interconnecting said inner junction to said lower end of said outer member;

means connecting said first brace to said second brace intermediate said inner member and said outer member; and means for connecting said inner member to said interconnecting portion of the I-beam with said upper and lower ends of said inner member being located between the top and bottom portions of the I-beam for connecting the improved outrigger assembly to the metallic I-beam of the building structure.

9. An improved outrigger assembly as set forth in claim 8, wherein said upper member extends substantially perpendicularly to said inner and outer members.

10. An improved outrigger assembly as set forth in claim 8, wherein said first and second braces are connected to said inner and outer members by welding.

11. An improved outrigger assembly as set forth in claim 8, wherein said first and second braces are connected to said inner and outer junctions by welding.

12. An improved outrigger assembly as set forth in claim 8, wherein said first and second braces are interconnected by welding.

13. An improved outrigger assembly as set forth in claim 8, wherein said means for connecting said inner member to said I-beam includes welding.

14. An improved outrigger assembly as set forth in claim 8, wherein said outer member is unitary with said upper member through a bend disposed at said outer end of said upper member and said upper end of said outer member.

* * * * *